US006117389A

United States Patent [19]

Nabeshima et al.

[11] Patent Number: 6,117,389

[45] Date of Patent: Sep. 12, 2000

[54] TITANIUM KILLED STEEL SHEET AND METHOD

[75] Inventors: Seiji Nabeshima; Hirokazu Tozawa, both of Okayama; Kenichi Sorimachi, Chiba, all of Japan

[73] Assignee: Kawasaki Steel Corporation, Japan

[21] Appl. No.: 09/160,460

[22] Filed: Sep. 24, 1998

[30] Foreign Application Priority Data

| | | | |
|---|---|---|---|
| Sep. 29, 1997 | [JP] | Japan | 9-264395 |
| Mar. 30, 1998 | [JP] | Japan | 10-084161 |
| Jun. 18, 1998 | [JP] | Japan | 10-171702 |

[51] Int. Cl.[7] ..... C22C 38/14; C22C 38/06; C22C 1/02; C22B 9/04; C22B 9/10

[52] U.S. Cl. ..... 420/83; 420/84; 420/85; 420/129; 75/508; 164/474; 164/58.1

[58] Field of Search ..... 148/331, 320, 148/540, 541; 420/126, 83, 84, 85, 129; 75/129, 508, 10.64, 10.48; 164/474, 58.1

[56] References Cited

FOREIGN PATENT DOCUMENTS

| | | |
|---|---|---|
| 0 829 546 | 3/0000 | European Pat. Off. . |
| 0 709 469 | 5/1996 | European Pat. Off. . |
| 0 785 283 | 7/1997 | European Pat. Off. . |
| 58 204117 | 11/1983 | Japan . |
| 08 283823 | 10/1996 | Japan . |
| 09 192783 | 7/1997 | Japan . |

*Primary Examiner*—Deborah Yee
*Attorney, Agent, or Firm*—Austin R. Miller

[57] ABSTRACT

Titanium killed steel sheets which are not troubled by nozzle clogging while they are produced in a continuous casting process, have few surface defects caused by cluster-type inclusions, and are highly rust resistant, and are formed from a melt of titanium killed steel that contains any one or two of Ca and metals REM in an amount of not smaller than 0.0005% by weight, and wherein the steel contains major oxide inclusions of any one or two of CaO and REM oxides in an amount of from about 5 to 50% by weight, Ti oxides in an amount of not larger than about 90% by weight, and $Al_2O_3$ in an amount of not larger than about 70% by weight.

18 Claims, 3 Drawing Sheets

TITANIUM KILLED STEEL SHEET AND METHOD

FIELD OF THE INVENTION

The present invention relates to titanium killed steel sheet with improved surface properties, and to a method for producing the same. Specifically, the invention improves the surface properties of steel sheet and even those of galvanized sheet and coated sheet of, for example, low-carbon steel, ultra-low-carbon steel and stainless steel. This is done by controlling the oxide inclusions in such steel, particularly by controlling big cluster-type inclusions to finely disperse them in the sheet and to remove the negative influences of the inclusions that may be starting points for rusting of the sheet.

"Titanium killed steel" as referred to herein is a generic term for continuous cast slabs and especially for steel sheets such as hot rolled sheets, cold rolled sheets, surface-treated sheets, etc.

BACKGROUND OF THE INVENTION

At the beginning, a popular method of deoxidizing steel utilized ferrotitanium for preparing steel deoxidized with Ti, for example, as disclosed in Japanese Patent Publication (JP-B) Sho-44-18066. Recently, however, a large amount of steel has been deoxidized with Al and has an Al content of not smaller than 0.005% by weight. This is done in order to obtain steel having a stable oxygen concentration at low production cost.

For producing steel deoxidized with Al, vapor stirring or RH-type vacuum degassing is employed, in which the oxide formed is coagulated, floated on the surface of steel melt and removed from the steel melt. In that method, however, the formed oxide $Al_2O_3$ inevitably remains in the steel slabs. In addition, the oxide $Al_2O_3$ is formed in clusters and is therefore difficult to remove. As the case may be, cluster-type oxide inclusions of not smaller than hundreds of $\mu$m in size may remain in the deoxidized steel. Such cluster-type inclusions, if trapped in the surfaces of the slabs, will produce surface defects such as scabs or slivers, which are fatal to steel sheets for vehicles that are required to have good exterior appearance. In addition, the Al deoxidation method is further disadvantageous in that formed $Al_2O_3$ will adhere onto the inner wall of the immersion nozzle for steel melt injection from the tundish to the mold, thereby causing nozzle clogging.

For overcoming the problems of the Al deoxidation method, a proposed method added Ca to the aluminium-killed steel melt to form composite oxides of $CaO/Al_2O_3$. (For example, see Japanese Patent Application Laid-Open (JP-A) Sho-61-276756, Sho-58-154447 and Hei-6-49523).

The object of Ca addition was to react $Al_2O_3$ with Ca thereby forming low-melting-point composite oxides such as $CaOAl_2O_3$, $12CaOAl_2O_3$, $3CaOAl_2O_3$ and the like to overcome the problems noted above.

However, adding Ca to steel melt results in formation of CaS through reaction of Ca with S in the steel, and the resulting CaS causes rusting. In this respect, JP-A Hei-6-559 has proposed a method of limiting the amount of Ca allowed to remain in steel to from 5 to less than 10 ppm for the purpose of preventing rusting. However, even if the Ca amount is so limited to less than 10 ppm, when the composition of the $CaO—Al_2O_3$ oxides remaining in the steel is not proper, especially when the CaO content of the oxides is not smaller than 30%, then the solubility of S in the oxides increases whereby CaS is inevitably formed around the inclusions while the steel melt is being cooled or solidified. As a result, the steel sheets tend to rust from the starting points of CaS, and have poor surface properties. If the steel sheets thus having rusting points are directly surface-treated for galvanization or coating, the surface-treated sheets do not have a uniform good surface quality.

On the other hand, if the CaO content of the inclusions is not larger than 20% but the $Al_2O_3$ content is high, especially when the $Al_2O_3$ content thereof is not smaller than 70%, the inclusions shall have an elevated melting point and will be easily sintered together, thereby creating still other problems; nozzle clogging is inevitable during continuous casting, and, in addition, many scabs and slivers are formed on the surfaces of steel sheets to the detriment of surface properties.

A steel deoxidation method using Ti but not Al has been disclosed in JP-A Hei-8-239731. No cluster-type oxides are formed, but the ultimate oxygen concentration in the deoxidized steel is high and there are numerous inclusions as compared with the Al deoxidation method. In particular, in the Ti deoxidation method, the inclusions formed are in the form of Ti oxides/$Al_2O_3$ composites which are in granular dispersion of particles of from about 2 to 50 $\mu$m in size. Accordingly, in that method, the surface defects caused by cluster-type inclusions are reduced. However, the Ti deoxidation method remains disadvantageous in that, for steel melt with $Al \leqq 0.005\%$ by weight, when the Ti concentration in the melt is 0.010% by weight or more, the solid-phase Ti oxides formed adhere to the inner surface of the tundish nozzle while carrying steel therein, and continue to grow, thereby inducing nozzle clogging.

In order to solve the nozzle clogging problem, JP-A Hei-8-281391 has proposed a modification of the Ti deoxidation method not using Al, in which the oxygen content of the steel melt that passes through the nozzle is controlled, in order to prevent growth of $Ti_2O_3$ on the inner surface of the nozzle. However, since the oxygen control is limited, the method is still disadvantageous in that the castable amount of steel is limited (up to 800 tons or so). In addition, with the increase of nozzle clogging the level control for the steel melt in the mold becomes unstable. Thus, in fact, the proposed modification cannot provide any workable solution of the problem.

According to the technique disclosed in JP-A Hei-8-281391, which is designed to prevent tundish nozzle clogging, the Si content of the steel melt is optimized to form inclusions having a controlled composition of $Ti_3O_5—SiO_2$ whereby the growth of $Ti_2O_3$ on the inner surface of the nozzle is prevented. However, the mere increase of Si content could not always result in the intended formation of $SiO_2$ in the inclusions, for which at least the requirement of (wt. % Si)/(wt. % Ti)>50 must be satisfied. Accordingly, in the proposed method, where the Ti content of steel to be cast is 0.010% by weight, the Si content thereof must be not smaller than 0.5% by weight in order to form $SiO_2$—Ti oxides. However, the increase in the Si content hardens the steel material while worsening the galvanizability of the material. Specifically, the increase in the Si content has significant negative influences on the surface properties of steel sheets. Accordingly, the proposal in JP-A Hei-8-281391 still cannot produce any radical solution of the problem.

JP-B Hei-7-47764 has proposed a non-aging, cold-rolled steel sheet that contains low-melting-point inclusions of 17 to 31 wt. % MnO—Ti oxides, for which steel is deoxidized to an Mn content of from 0.03 to 1.5% by weight and a Ti content of from 0.02 to 1.5% by weight. In this proposal, the MnO—Ti oxides formed have a low melting point and are in a liquid phase in the steel melt. The steel melt does not adhere to the tundish nozzle while it passes therethrough, and is well injected into a mold. Thus, the proposal is effective for preventing tundish nozzle clogging. However, as so reported by Yasuyuki Morioka, Kazuki Morita, et al. in "Iron and Steel", 81 (1995), page 40, the concentration ratio of Mn to Ti in steel melt must be (wt. % Mn)/(wt. % Ti)>100 in order to form the intended MnO—Ti oxides having an MnO content of from 17 to 31%. This is because of the difference of oxygen affinity between Mn and Ti. Therefore, when the Ti content of steel to be cast is 0.010% by weight, the Mn content thereof must be at least 1.0% by weight in order to form the intended MnO—Ti oxides. However, too much Mn, more than 1.0% by weight in steel, hardens the steel material. For these reasons, therefore, it is in fact difficult to form the inclusions of 17 to 31 wt. % MnO—Ti oxides.

JP-A Hei-8-281394 has proposed another modification for preventing tundish nozzle clogging in the method of Al-less deoxidation of steel using Ti, in which a nozzle is used that is made from a material that contains particles of $CaO/ZrO_2$. In the proposed modification, even when $Ti_3O_5$ formed in the steel melt is trapped in the nozzle, it is converted into low-melting-point inclusions of $TiO_2$—$SiO_2$—$Al_2O_3$—CaO—$ZrO_2$ and is prevented from growing further.

In that modification, however, when the oxygen concentration in the steel melt being cast is high, the $TiO_2$ content of the adhered inclusions shall be high so that the inclusions could not be converted into the intended low-melting-point ones. In that case, the proposed modification cannot produce the intended result of preventing nozzle clogging. On the other hand, when the oxygen concentration in the steel melt is low, another problem arises: the nozzle is fused and damaged. In any event, the proposed modification is not a satisfactory measure for preventing nozzle clogging.

The prior art techniques noted above for preventing nozzle clogging, when applied to continuous casting, still require blowing of Ar gas or $N_2$ gas into the immersion nozzle through which the steel melt being cast is injected through the tundish nozzle into the mold. However, this is still disadvantageous in that the gas blown into the immersion nozzle tends to be trapped in the coagulation shell to form blowhole defects.

SUMMARY OF THE INVENTION

An important object of the invention is to provide titanium killed steel, especially sheets of the steel having no surface defects caused by cluster-type inclusions.

Another object is to provide titanium killed steel, especially steel sheets without causing nozzle clogging during continuous casting.

Still another object is to provide titanium killed steel, especially steel sheets which are substantially free of rust caused by the presence of starting points of inclusions; and Yet another object is to provide a method for producing titanium killed steel, especially steel sheets by continuously casting without requiring any gas blow of Ar, $N_2$ or the like and, which cause no blow hole defects.

We have found that, if their composition is controlled within a specific range, the oxide inclusions remaining in cast steel do not cause nozzle clogging and can be finely dispersed in the steel without growing into large clusters, and that only oxides causing neither nozzle clogging nor rusting can be formed in the cast steel to obtain steel sheets having remarkably good surface properties.

Based on such findings, the present invention provides titanium killed steel sheets with good surface properties to be produced through deoxidation of steel melt with Ti, which steel alternatively satisfies the following requirements:

when the Ti content of the steel is between about 0.010 and about 0.50% by weight, the ratio of the Ti content to the Al content of the steel, (wt. % Ti)/(wt. % Al) is substantially equal to or greater than 5;

when the Ti content of the steel is about 0.010% by weight or above, and the Al content thereof is substantially equal to or less than about 0.015% by weight, the ratio of the Ti content to the Al content, (wt. % Ti)/(wt. % Al) is less than about 5;

that the steel contains a metal selected from the group consisting of Ca and rare earth metals added in an amount of about 0.0005% by weight or above; and that the oxide inclusions in the steel are such that the amount of any one or two of CaO and REM oxides falls between about 5 and 50% by weight of the total amount of the oxide inclusions, that the amount of Ti oxides is not larger than about 90% by weight of the total amount of the oxide inclusions, and that the amount of $Al_2O_3$ is not larger than about 70% by weight of the total amount of the oxide inclusions.

Preferably, the invention provides titanium killed steel to be produced through deoxidation of steel melt with Ti, and also a method for producing it, which are characterized in that the steel satisfies the following requirements:

when the Ti content of the steel falls between about 0.025 and 0.50% by weight, the ratio of the Ti content to the Al content of the steel, (wt. % Ti)/(wt. % Al) is equal to or greater than about 5;

when the Ti content of the steel is equal to or greater than about 0.025% by weight and the Al content thereof is equal to or less than about 0.015% by weight, the ratio of the Ti content to the Al content, (wt. % Ti)/(wt. % Al) is less than about 5;

and that the amount of Ti oxides in the steel falls between about 20 and 90% by weight of the total amount of the oxide inclusions therein.

More preferably, the invention provides titanium killed steel through deoxidation of steel melt with Ti, and also a method for producing it, which are characterized in that the steel contains Ti added thereto in an amount of from about 0.025 to 0.075% by weight while substantially satisfying the ratio of the Ti content to the Al content of the steel, (wt. % Ti)/(wt. % Al)≧5, and that the amount of Ti oxides in the steel falls between about 20 and 90% by weight of the total amount of the oxide inclusions therein.

Also preferably, the steel and the method for producing it of the invention are such that the steel contains, apart from the additives of Ti, Al, Ca and REM, substantially the following amounts of essential components of C≦0.5% by weight, Si≦0.5% by weight, Mn falling between 0.05 and 2.0% by weight, and S≦0.050% by weight; and that the oxide inclusions in the steel may optionally contain $SiO_2$ in an amount not larger than about 30% by weight and MnO in an amount of not larger than about 15% by weight. The invention is especially effective for ultra-low-carbon steel with C substantially≦0.01% by weight in which cluster-type inclusion defects and blowhole defects are easily formed.

It is desirable that at least about 80% by weight of the oxide inclusions in the steel are in the form of granulated or crushed particles of not larger than about 50 μm in size.

In the steel production method of the invention, it is desirable that Ca is added to the steel in the form of powdery or granulated metal Ca, or in the form of granulated or massive Ca-containing alloys such as CaSi alloys, CaAl alloys, CaNi alloys or the like, or in the form of wires of such Ca alloys.

In the method, it is also desirable that the REM metals are added to the steel in the form of powdery or granulated REM metals, or in the form of granulated or massive REM-containing alloys such as FeREM alloys or the like, or in the form of wires of such REM alloys.

In the method, it is further desirable that the steel melt is continuously cast into a mold via a tundish without blowing argon gas or nitrogen gas into the tundish or into the immersion nozzle. It is further desirable that the steel melt is decarbonized in a vacuum degassing device and then deoxidized with a Ti-containing alloy, and thereafter one or two of Ca and REM, as well as an alloy or mixture containing one or more elements selected from the group consisting of Fe, Al, Si and Ti are added to the resulting steel melt.

In the method, it is further desirable that the steel melt is decarbonized in a vacuum degassing device and then subjected to primary deoxidation with any of Al, Si and Mn to thereby reduce the amount of oxygen dissolved in the steel melt to about 200 ppm or less, and thereafter the resulting steel melt is deoxidized with a Ti-containing alloy.

DETAILED DESCRIPTION OF THE INVENTION

To produce the titanium killed steel sheets of the invention, a steel melt must be prepared, of which the composition falls approximately within the range satisfying the following requirement (1) or (2):

(1) The Ti content of the steel falls between about 0.010 and 0.50% by weight, but preferably between about 0.025 and 0.50% by weight, more preferably between about 0.025 and 0.075% by weight, and the Al content thereof is defined by the ratio, (wt. % Ti)/(wt. % Al) is substantially equal to or greater than 5, or (2) The Ti content is not smaller than about 0.010% by weight, and the Al content is substantially defined by Al≦0.015% by weight and by the ratio, (wt. % Ti)/(wt. % Al) being less than about 5.

Figure 1:
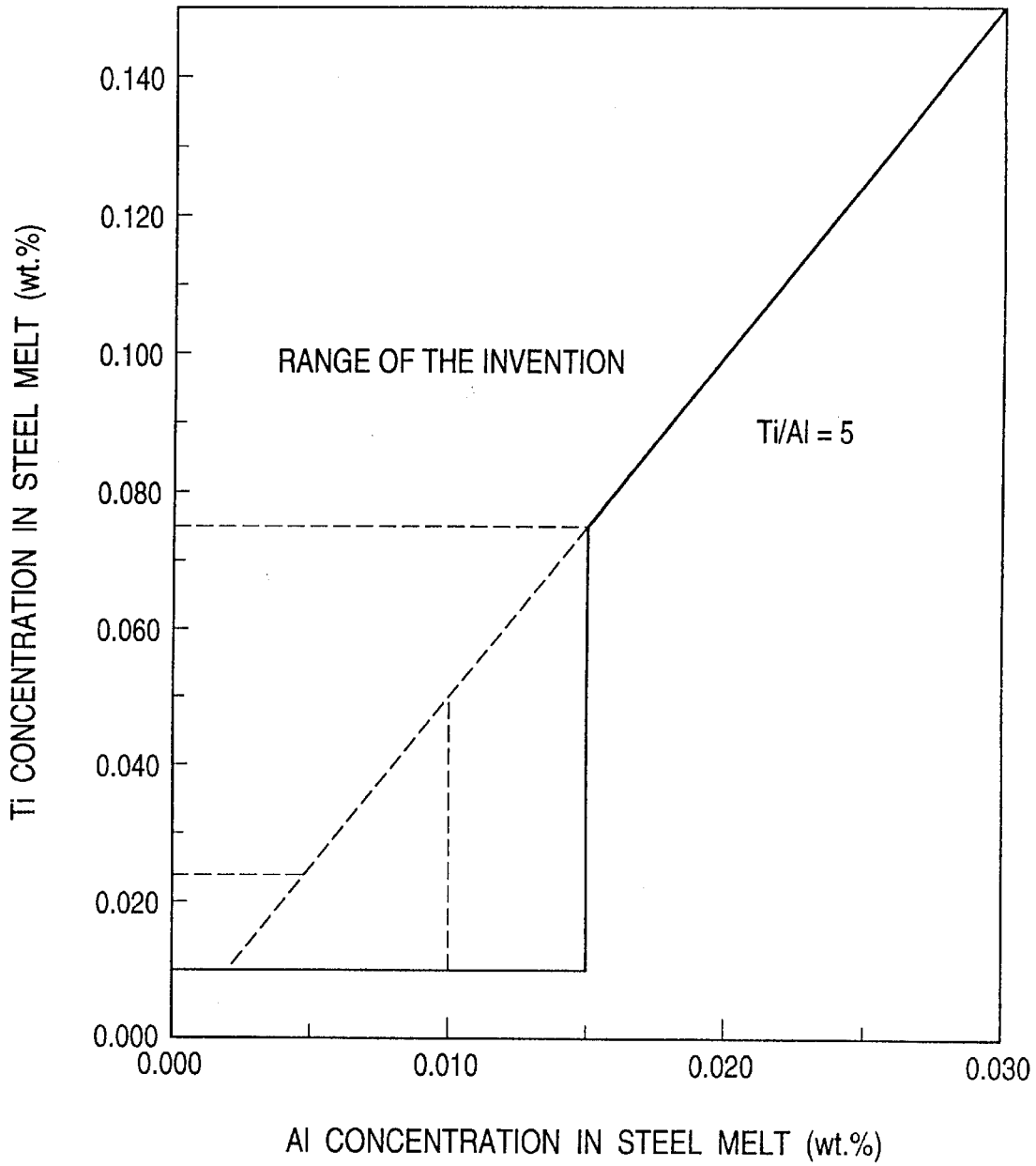
FIG. 1 is a graph substantially indicating the concentration range of Ti and Al to be in the substantially steel sheets of the invention.

FIG. 1 of the drawings shows the approximate range of Al and Ti to which the invention is applied. In particular, the invention is advantageously applied to cold-rolled steel sheets of, for example, titanium-killed low-carbon steel, titanium killed ultra-low-carbon steel, titanium killed stainless steel or the like, of which the essential components are mentioned hereinunder. The invention is described below with reference to embodiments of such steel sheets.

In the invention, the additives Ti and Al are so controlled that Ti falls between about 0.010 and 0.50% by weight, preferably between about 0.025 and 0.50% by weight, more preferably between about 0.025 and 0.075% by weight with the ratio (wt. % Ti)/(wt. % Al) approximately≧5. This is because, if Ti is substantially<0.010% by weight, its deoxidizing ability is poor, resulting in increase of the total oxygen concentration in the steel melt; the physical characteristics, such as elongation and drawability of the steel sheets formed from it are poor. In that case, the Si and Mn concentration may be increased to enlarge the deoxidizing ability. However, when Ti is less than about 0.010% by weight, the increase of Si and Mn concentration results in an increase in $SiO_2$ or MnO-containing inclusions by which the steel material is hardened and its galvanizability is lowered. In order to overcome the problems, (wt. % Ti)/(wt. % Al) is about≧5, or the ratio (wt. % Mn)/(wt. % Ti) is less than about 100. If so, however, the concentration of Ti oxides in the inclusions shall be about 20% or more.

On the other hand, if the Ti content is larger than about 0.50% by weight, the hardness of the steel material is too high for sheets. For the other applications, the properties of the steel material, even though having such a large Ti content, could not be improved much, and the production costs are increased. For these reasons, the uppermost limit of the Ti content is defined to be about 0.50% by weight.

Where the concentration ratio of Ti/Al falls to about (wt. % Ti)/(wt. % Al)<5, the composition of the steel melt is defined to have an Al content of not larger than about 0.015% by weight, preferably not larger than about 0.10% by weight. The reason is because, if, on the contrary, the Al content is larger than 0.015% and (wt. % Ti)/(wt. % Al)<5, the steel could not be deoxidized with Ti but would be completely deoxidized with Al, in which cluster-type oxide inclusions are formed having an $Al_2O_3$ content of about 70% or more. This is contrary to the objectives of the invention. The subject matter of the invention is directed to the formation of inclusions that consist essentially of Ti oxides and preferably contain CaO and REM oxides in the steel, to thereby attain the objects of the invention.

The oxide inclusions in the steel of the invention may optionally contain other oxides such as $ZrO_2$, MgO and the like in an amount not larger than about 10% by weight.

In producing the titanium killed steel sheets of the invention, it is important that the starting steel melt is first deoxidized with a Ti-containing alloy such as FeTi or the like to thereby form oxide inclusions consisting essentially of Ti oxides in the steel. Being different from those formed in steel as deoxidized with Al, the inclusions formed in the steel of the invention are not big cluster-type ones, and most of them have a size of from about 1 to 50 $\mu$m.

However, if the Al content of the deoxidized steel is larger than 0.015% by weight, the inclusions in the steel to which Ca and metals REM have been added could not contain Ti oxides in an amount of about 20% by weight or more. If so, the inclusions in the steel could not have the composition defined herein, resulting in the fact that big $Al_2O_3$ clusters are formed in the steel. Such big $Al_2O_3$ clusters could not be reduced even when a Ti alloy is further added to the steel to increase the Ti content of the steel; they remain in the steel still in the form of big cluster-type inclusions. For these reasons, therefore, it is necessary to form inclusions of Ti oxides in the steel of the invention while the steel is being produced.

If the method of the invention was compared with the conventional deoxidation method using Al, it is to be noted that the availability of the Ti alloy used therein is low and, in addition, the other alloys to be used for controlling the composition of the inclusions in the steel are expensive since the steel contains Ca and REM. Therefore, from the economic aspect, it is desirable that the amount of those alloys added to the steel is minimized as much as possible within a range acceptable for compositional control of the inclusions to be formed in the steel.

To that effect, it is desirable to subject the steel to primary deoxidation, prior to adding a deoxidizer such as a Ti-containing alloy or the like to the steel, to thereby lower the amount of oxygen dissolved in the steel melt and to lower the FeO and MnO content in the slabs. The primary deoxidation may be effected with such a small amount of Al that the Al content of the deoxidized steel melt could be less than about 0.010% by weight (Al about≦0.010% by weight), or by adding Si, FeSi, Mn or FeMn to the starting steel.

As so mentioned hereinabove, the inclusions of Ti oxides as formed through deoxidation with Ti may be finely dispersed in the deoxidized steel in the form of particles of from about 2 to 20 $\mu$m or so in size. Therefore, the steel sheets have no surface defects to be caused by cluster-type inclusions. However, the Ti oxides form a solid phase in steel melt. In addition, ultra-low-carbon steel has a high solidification point. Therefore, the Ti oxides in the melt of steel, especially in that of ultra-low-carbon steel, will grow along with the steel components on the inner surface of a tundish nozzle while the steel melt is cast through the nozzle, whereby the nozzle will be clogged.

To overcome this problem in producing the steel sheets of the invention, any one or two of Ca and REM are added to the steel melt deoxidized with a Ti alloy, in an amount of about 0.0005% by weight or more, by which the oxide composition in the steel melt is so controlled that the amount of Ti oxides therein is about 90% by weight or less, preferably from about 20 to 90% by weight, more preferably about 85% by weight or less, that the amount of CaO and/or REM oxides therein is about 5% by weight or more, preferably from about 8 to about 50% by weight, and that the amount of $Al_2O_3$ is not larger than about 70% by weight. The oxide inclusions having the defined composition have a low melting point and are well wettable with steel melt. In this condition, the Ti oxides containing steel are effectively prevented from adhering to the inner wall of the nozzle.

Figure 2:
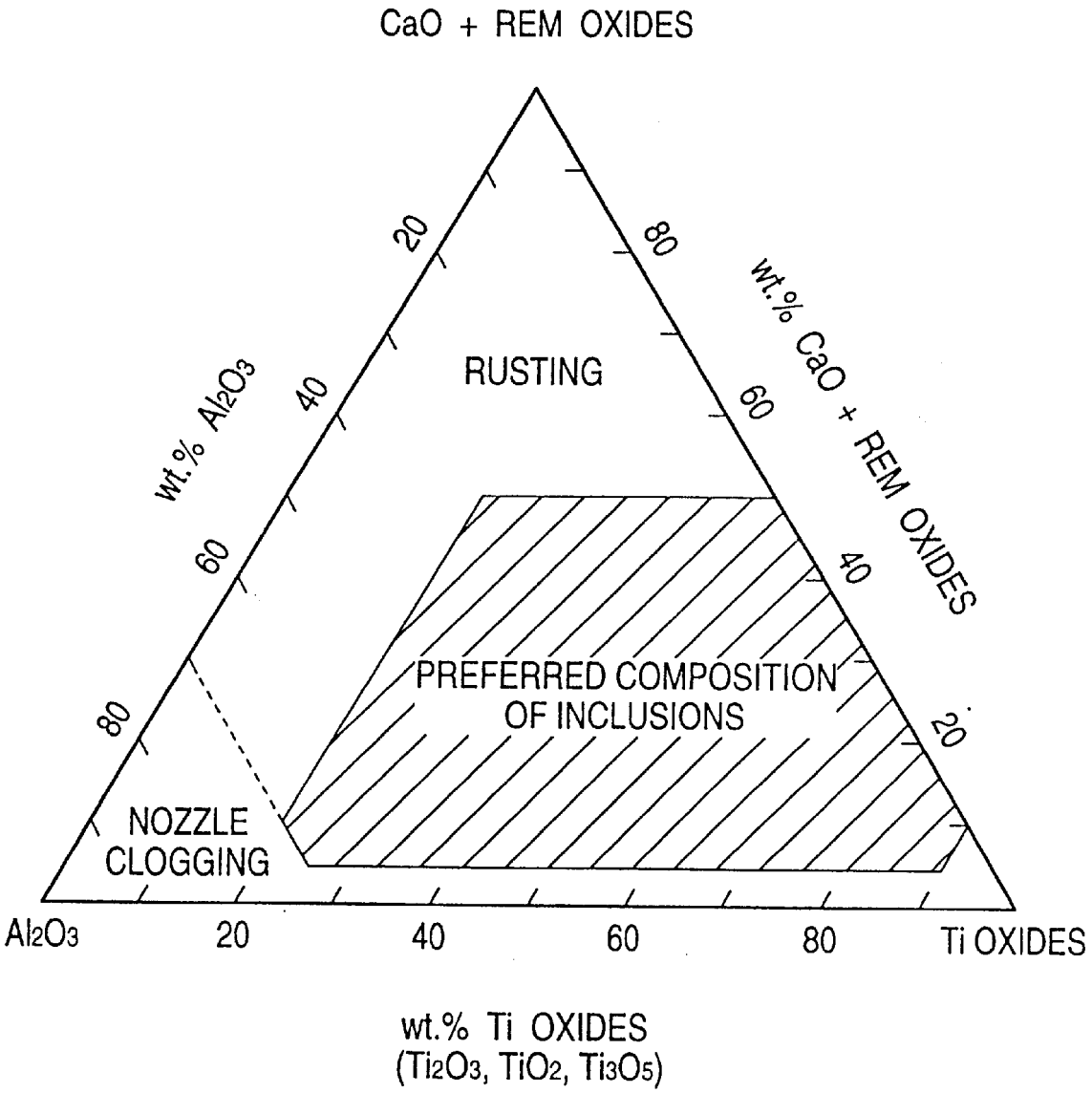
FIG. 2 is a graph substantially indicating the composition range of inclusions to be in the steel sheets of the invention.

FIG. 2 shows the approximate compositional range of the oxide inclusions that are formed in the steel sheets of the invention.

To determine the compositional ratio of the oxide inclusions in a steel sheet, any ten oxide inclusions are randomly sampled out of the steel sheet and analyzed for the constituent oxides, and the resulting data are averaged.

As in FIG. 2, even if steel is deoxidized with Ti and then any one or two of Ca and REM are added to the deoxidized steel, but when the $Ti_2O_3$ content of the inclusions formed in the steel is not smaller than about 90% by weight or when the amount of CaO and REM oxides ($La_2O_3$, $Ce_2O_3$, etc.) in the inclusions is smaller than about 5% by weight, then the melting point of the inclusions formed could not be satisfactorily lowered even though the inclusions might not form big clusters in the steel, thereby resulting in the fact that the inclusions adhere onto the inner surface of a nozzle along with steel components to cause nozzle clogging during casting.

Figure 3:
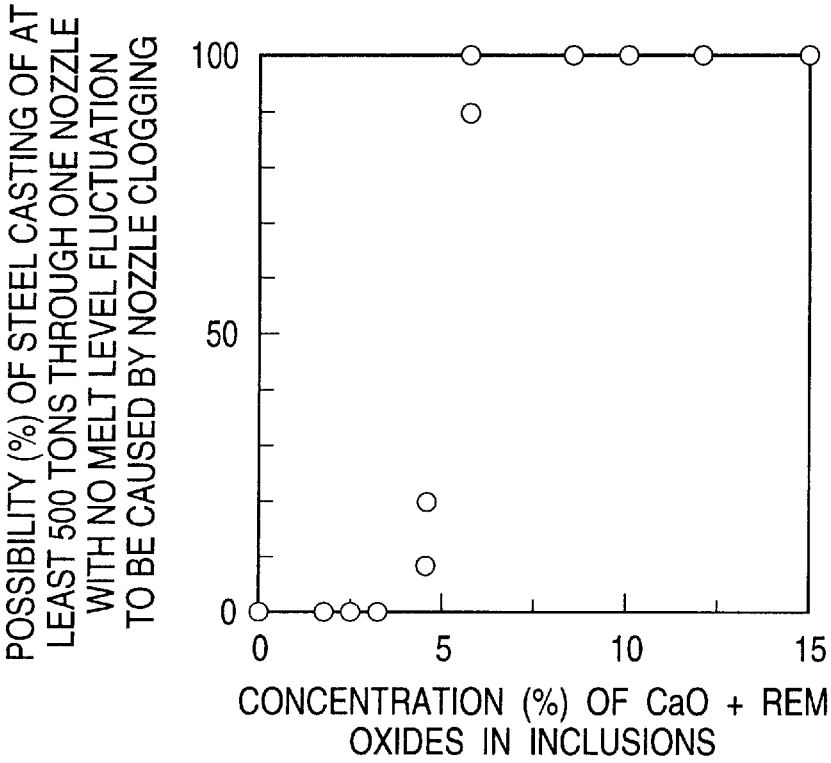
FIG. 3 is a graph indicating the influence of the CaO+REM oxide concentration in inclusions on the nozzle clogging during casting.

FIG. 3 shows the relationship between the concentration of CaO and REM oxides in the inclusions formed in steel and nozzle clogging. Measurements were made repeatedly on steel castings in an amount of 500 tons or more through one nozzle. Those runs that were achieved, with no melt level fluctuation caused by clogging of the nozzle in the absence of Ar or $N_2$ gas blowing, were counted. As shown in FIG. 3, good results were obtained when the concentration of CaO and REM oxides in the inclusions was about 5% by weight or more. Above that amount nozzle clogging frequently (or always) occurred.

On the other hand, however, when the concentration of CaO and REM oxides in the inclusions was larger than about 50% by weight, S was easily trapped in the inclusions.

Figure 4:
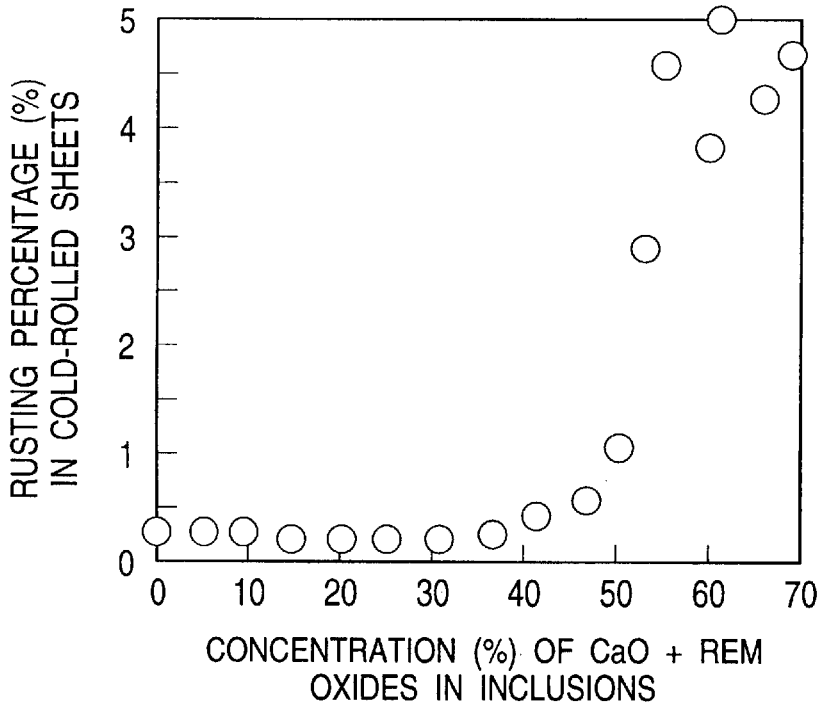
FIG. 4 is a graph indicating the influence of the CaO+REM oxide concentration in inclusions (when Ti oxides≧20%) on the rusting of steel sheets.

As shown in FIG. 4 of the drawings, tests were conducted after degreasing with methylene chloride, and 10 sheet samples of each composition, each 100 millimeters square, were deposited in a thermo-hygrostat at 60° C. and a humidity of 95% for 500 hours. The effects of CaO and REM were evaluated in terms of rusting percentage in the samples. At CaO and REM percentages above about 50% in the inclusions, CaS and REM sulfides (LaS, CeS) were formed inside and around the inclusions being solidified. As a result, those sulfides were found to be the starting points for rusting, resulting in some of the cold-rolled steel sheets becoming substantially rusted.

More desirably, the composition of the inclusions was found to be such that the amount of $Ti_2O_3$ falls between about 30 and 80% by weight and the amount of one or two of CaO and REM oxides ($La_2O_3$, $Ce_2O_3$, etc.) falls between about 10 and 40% by weight in total.

If the amount of Ti oxides in the inclusions noted above is not larger than about 20% by weight, the steel containing the inclusions is not well deoxidized by Ti, but is deoxidized with Al. The $Al_2O_3$ concentration in the steel is high, thereby causing nozzle clogging while the steel is being cast. If the concentration of CaO and REM oxides in the inclusions is too high, the steel containing the inclusions rusts with ease. For these reasons, the concentration of Ti oxides in the inclusions is defined to be about 20% by weight or more. On the other hand, however, if the concentration of Ti oxides in the inclusions is about 90% by weight or more, the concentration of CaO and REM oxides therein becomes too small, thereby resulting in the steel containing inclusions that clog nozzles while cast. Therefore, the concentration of Ti oxides in the inclusions is defined to fall between about 20 and 90% by weight.

Regarding $Al_2O_3$ in the inclusions, if the $Al_2O_3$ content of the inclusions is higher than about 70% by weight, the inclusions have a high melting point and cause nozzle clogging. If so, in addition, the inclusions are in clusters, and non-metallic inclusion defects increase in the resulting steel sheets.

In addition, the inclusions are so controlled that their $SiO_2$ content is about 30% by weight or less, and the MnO content thereof is about 15% by weight or less. If the amount of these oxides is higher than the defined range, the steel containing the inclusions is no longer a titanium killed steel to which the present invention is directed. The steel that contains the inclusions having the composition of that type does not clog nozzles and does not rust, even when no Ca is added thereto. Moreover, in order to make the inclusions contain $SiO_2$ and MnO, the Si and Mn concentrations in the steel melt must be controlled to substantially satisfy Mn/Ti>100 and Si/Ti>50, as mentioned hereinabove. Apart from those oxides, the inclusion may further contain any other oxides such as $ZrO_2$, MgO and the like in an amount not larger than about 10% by weight.

To determine the compositional ratio of the oxide inclusions, any ten oxide inclusions are randomly sampled out of one steel sheet and analyzed for the constituent oxides, and the resulting data are averaged.

When the method of the invention is compared with the conventional deoxidation method using Al, it is to be noted that the availability of the Ti alloy used therein is low and, in addition, the steel sheets produced are expensive as containing Ca and metals REM added thereto. Therefore, it is desirable that the components used for compositional control of the inclusions in steel is minimized as much as possible. If possible, the starting steel for the invention is desirably subjected to primary deoxidation so that the amount of oxygen dissolved in the steel melt, not subjected to final deoxidation with Ti, is at most about 200 ppm. Preferably, the primary deoxidation is effected with a small amount of Al (in this case, the Al content of the deoxidized steel melt shall be at most about 0.010% by weight), or with Si, FeSi, Mn or FeMn.

80% by weight or more of the inclusions as controlled in the manner noted above have a mean particle size of 50 $\mu$m or smaller. The reason why the mean particle size of the inclusions is defined to be about 50 $\mu$m or smaller is that, in the deoxidation method of the invention, few inclusions having a mean particle size of about 50 $\mu$m or larger are formed. In general, inclusions having a mean particle size of about 50 $\mu$m or larger are almost exogenous ones to be derived from slag, mold powder and the like. To determine the mean particle size of the inclusions, the diameter of each inclusion particle is measured in a right-angled direction, and the resulting data are averaged.

80% by weight or more of the inclusions present in the steel of the invention have a mean particle size falling within the defined range as above. This is because, if less than about 80% by weight of the inclusions have the defined mean particle size, the inclusions are unsatisfactorily controlled, thereby causing surface defects of steel coils to be formed, and even nozzle clogging during steel casting.

Since the composition of the inclusions present in the steel of the invention is controlled in the manner defined hereinabove, no oxide adheres to the inner surfaces of the tundish nozzle and the mold immersion nozzle while the steel is cast continuously. Therefore, in the method of producing steel sheets of the invention, vapor blowing of Ar, $N_2$ or the like into the tundish and the immersion nozzle for preventing oxide adhesion are unnecessary. As a result, the method of the invention is advantageous in that, while steel melt is continuously cast into slabs, no mold powder enters the melt and the slabs produced have no defects that might be caused by mold powder. In addition, the slabs have no blowhole defects that might be caused by vapor blowing.

The composition of the steel material to which the invention is directed contains, in addition to the additives Ti, Al, Ca and REM positively added for inclusion control, the following essential components are:

C: Though not specifically defined, the C content of the steel of the invention to be cast into sheets is not larger than about 0.5% by weight, preferably not larger than about 0.10% by weight, more preferably not larger than about 0.01% by weight.

Si: If the ratio (wt. % Si)/(wt. % Ti)$\geqq$50, $SiO_2$ is formed in the inclusions. If so, the steel is a silicon killed steel but not a titanium killed steel. In particular, when the Si content is larger than about 0.50% by weight, the quality of the steel material is poor and its galvanizability is also poor and the surface properties of the steel sheets formed are poor. Therefore, the Si content of the steel of the invention is defined to be not larger than about 0.50% by weight.

Mn: If the ratio (wt. % Mn)/(wt. % Ti)$\geqq$100, MnO is formed in the inclusions. If so, the steel is a manganese killed steel but not a titanium killed steel. In particular, when the Mn content is larger than about 2.0% by weight, the steel material is very hard. Therefore, the Mn content is defined to be not larger than about 2.0% by weight, preferably not larger than about 1.0% by weight.

S: If the S content is larger than about 0.050% by weight, the amount of CaS and REM sulfides in the steel melt is excessive, and the steel sheets produced rust profusely. Therefore, the S content is desirably up to about 0.050% by weight.

If desired, the steel of the invention may additionally contain Nb in an amount of not larger than about 0.100% by weight, B in an amount of not larger than about 0.050% by weight, and Mo in an amount of not larger than about 1.0% by weight. Those additional elements, if added to the steel, act to improve the deep drawability of the steel sheets, to make the steel sheets non-brittle in secondary working, and to increase the tensile strength of the steel sheets.

If further desired, the steel of the invention may still additionally contain Ni, Cu and Cr. Those additional elements improve the corrosion resistance of the steel sheets to which they are added.

The invention will now be described in further detail with reference to the following Examples, which, however, are not intended to limit or restrict the scope of the invention beyond the definitions set forth in the appended claims.

EXAMPLE 1

Production of Sample No. 1

300 tons of steel melt, after having been taken out of a converter, were decarbonized in an RH-type vacuum degassing device, whereby the steel melt was controlled to have a C content of 0.0012% by weight, an Si content of 0.004% by weight, an Mn content of 0.15% by weight, a P content of 0.015% by weight and an S content of 0.005% by weight, and the temperature of the steel melt was controlled to 1600° C. To the steel melt, added was Al in an amount of 0.5 kg/ton, by which the concentration of oxygen dissolved in the steel melt was lowered to 150 ppm. In this step, the Al concentration in the steel melt was 0.003% by weight. Then, the steel melt was deoxidized with Ti, by adding thereto an alloy of 70 wt. % Ti—Fe in an amount of 1.2 kg/ton. Next, FeNb and FeB were added to the steel melt to thereby condition the composition of the steel melt. After this, Fe-coated wire of 30 wt. % Ca-60 wt. % Si alloy was added to the steel melt in an amount of 0.3 kg/ton, to treat the steel melt with Ca. After having been thus Ca-treated, the steel melt had a Ti content of 0.050% by weight, an Al content of 0.002% by weight and a Ca content of 0.0020% by weight.

Next, using a continuous, 2-strand slab casting device, the steel melt was continuously cast into slabs. In this step, the inclusions existing in the steel melt in the tundish were in the form of spherical grains having a mean composition of 75 wt. % $Ti_2O_3$-15 wt. % CaO-10 wt. % $Al_2O_3$.

During the casting step, no Ar gas was blown into the tundish and the immersion nozzle. After continuous casting, the tundish and the immersion nozzle were checked, and a few deposits were found, adhered onto their inner walls.

Next, the continuous cast slab was hot-rolled into a sheet having a thickness of 3.5 mm, which was then cold-rolled to a thickness of 0.8 mm, and thereafter continuously annealed. Non-metallic inclusion defects of scabs, slivers, scale and the like were found in the surface of the annealed sheet at a low frequency of not more than 0.01/1000 m coil. Regarding the degree of rusting, the sheet presented no problem.

The cold-rolled sheet was electro-galvanized or hot-dip-galvanized, and the thus-galvanized sheets all had good surface properties.

The components constituting the steel sheet produced herein, and the mean composition of the major inclusions existing in the steel sheet and having a size of not smaller than 1 $\mu$m are shown in Table 1 below, as Sample No. 1 of the invention.

TABLE 1

| | Components of Steel Sheet (wt. %) | | | | | | | | | | | |
|---|---|---|---|---|---|---|---|---|---|---|---|---|
| No. | C | Si | Mn | P | S | Al | Ti | T.Ca | REM | Nb | B | T(O) |
| 1 | 0.0015 | 0.018 | 0.15 | 0.015 | 0.005 | 0.002 | 0.040 | 0.0015 | 0.0000 | 0.003 | 0.0005 | 0.0040 |
| 2 | 0.0023 | 0.012 | 0.12 | 0.016 | 0.012 | 0.002 | 0.015 | 0.0015 | 0.0000 | 0.015 | 0.0005 | 0.0055 |
| 3 | 0.0018 | 0.025 | 0.12 | 0.012 | 0.004 | 0.002 | 0.045 | 0.0003 | 0.0010 | 0.003 | 0.0001 | 0.0040 |
| 4 | 0.0012 | 0.010 | 0.12 | 0.010 | 0.004 | 0.003 | 0.026 | 0.0005 | 0.0000 | 0.005 | 0.0004 | 0.0050 |
| 5 | 0.0020 | 0.025 | 0.10 | 0.012 | 0.008 | 0.005 | 0.045 | 0.0022 | 0.0000 | 0.001 | 0.0001 | 0.0035 |
| 6 | 0.0015 | 0.026 | 0.10 | 0.015 | 0.010 | 0.003 | 0.050 | 0.0035 | 0.0000 | 0.001 | 0.0002 | 0.0032 |
| 7 | 0.0020 | 0.020 | 0.09 | 0.010 | 0.005 | 0.004 | 0.080 | 0.0012 | 0.0000 | 0.001 | 0.0001 | 0.0028 |
| 8 | 0.0013 | 0.015 | 0.15 | 0.015 | 0.003 | 0.001 | 0.042 | 0.0010 | 0.0000 | 0.007 | 0.0005 | 0.0042 |
| 9 | 0.0020 | 0.004 | 0.12 | 0.012 | 0.008 | 0.002 | 0.035 | 0.0009 | 0.0000 | 0.007 | 0.0007 | 0.0035 |
| 10 | 0.0015 | 0.006 | 0.10 | 0.020 | 0.006 | 0.008 | 0.060 | 0.0020 | 0.0000 | 0.002 | 0.0001 | 0.0025 |
| 11 | 0.0021 | 0.004 | 0.06 | 0.012 | 0.008 | 0.003 | 0.050 | 0.0018 | 0.0000 | 0.005 | 0.0005 | 0.0058 |
| 12 | 0.0017 | 0.015 | 0.10 | 0.013 | 0.006 | 0.003 | 0.030 | 0.0007 | 0.0020 | 0.005 | 0.0003 | 0.0050 |
| 13 | 0.0016 | 0.006 | 0.12 | 0:015 | 0.008 | 0.001 | 0.042 | 0.0015 | 0.0003 | 0.001 | 0.0001 | 0.0052 |
| 14 | 0.0020 | 0.004 | 0.09 | 0.020 | 0.010 | 0.003 | 0.016 | 0.0016 | 0.0005 | 0.002 | 0.0002 | 0.0065 |
| 15 | 0.0012 | 0.050 | 0.20 | 0.020 | 0.002 | 0.001 | 0.030 | 0.0020 | 0.0000 | 0.03 | 0.0001 | 0.0048 |
| 16 | 0.0020 | 0.200 | 0.60 | 0.010 | 0.012 | 0.004 | 0.026 | 0.0015 | 0.0000 | 0.001 | 0.0005 | 0.0062 |
| 17 | 0.0050 | 0.300 | 1.00 | 0.070 | 0.003 | 0.003 | 0.060 | 0.0020 | 0.0000 | 0.001 | 0.0010 | 0.0035 |
| 18 | 0.0030 | 0.500 | 0.50 | 0.020 | 0.004 | 0.002 | 0.028 | 0.0015 | 0.0000 | 0.001 | 0.0001 | 0.0040 |
| 19 | 0.0020 | 0.500 | 0.80 | 0.015 | 0.005 | 0.001 | 0.026 | 0.0018 | 0.0000 | 0.001 | 0.0001 | 0.0040 |
| 20 | 0.0050 | 0.200 | 1.80 | 0.020 | 0.005 | 0.001 | 0.028 | 0.0015 | 0.0000 | 0.001 | 0.0001 | 0.0035 |

| | Composition of Inclusions (wt. %) | | | | | | Adhesion of | Defects | Rusting Percentage | |
|---|---|---|---|---|---|---|---|---|---|---|
| No. | CaO | REM Oxides | Ti Oxides | $Al_2O_3$ | $SiO_2$ | MnO | Inclusions in Nozzle | in Coil (/1000 m) | in Coil (%) | Remarks |
| 1 | 14 | 0 | 75 | 9 | 0 | 0 | No | 0.01 | 0.10 | Samples of the Invention |
| 2 | 18 | 0 | 49 | 31 | 0 | 0 | No | 0.02 | 0.3 | |
| 3 | 5 | 10 | 65 | 18 | 0 | 0 | No | 0 | 0.1 | |
| 4 | 7 | 0 | 84 | 5 | 2 | 0 | No | 0 | 0.2 | |
| 5 | 28 | 0 | 35 | 33 | 1 | 0 | No | 0.01 | 0.2 | |
| 6 | 44 | 0 | 44 | 10 | 0 | 0 | No | 0.01 | 0.1 | |
| 7 | 25 | 0 | 63 | 10 | 0 | 0 | No | 0 | 0.1 | |
| 8 | 16 | 0 | 60 | 22 | 0 | 0 | No | 0 | 0.1 | |
| 9 | 10 | 0 | 68 | 20 | 0 | 0 | No | 0 | 0.1 | |
| 10 | 28 | 0 | 28 | 41 | 1 | 0 | No | 0.01 | 0.2 | |
| 11 | 22 | 0 | 59 | 17 | 1 | 0 | No | 0.02 | 0.1 | |
| 12 | 10 | 16 | 63 | 9 | 0 | 0 | No | 0 | 0.3 | |
| 13 | 20 | 2 | 67 | 8 | 0 | 0 | No | 0.01 | 0.1 | |
| 14 | 15 | 4 | 71 | 9 | 0 | 0 | No | 0 | 0.1 | |
| 15 | 25 | 0 | 56 | 13 | 0 | 1 | No | 0 | 0.2 | |
| 16 | 18 | 0 | 63 | 13 | 2 | 2 | No | 0.01 | 0.2 | |
| 17 | 24 | 0 | 55 | 14 | 3 | 2 | No | 0 | 0.2 | |
| 18 | 12 | 0 | 69 | 17 | 0 | 1 | No | 0 | 0.1 | |
| 19 | 14 | 0 | 46 | 9 | 28 | 2 | No | 0 | 0.1 | |
| 20 | 19 | 0 | 49 | 6 | 11 | 13 | No | 0 | 0.1 | |

EXAMPLE 2

Production of Sample No. 2

300 tons of steel melt were, after having been taken out of a converter, decarbonized in an RH-type vacuum degassing device, whereby the steel melt was controlled to have a C content of 0.0021% by weight, an Si content of 0.004% by weight, an Mn content of 0.12% by weight, a P content of 0.016% by weight and an S content of 0.012% by weight, and the temperature of the steel melt was controlled to be 1595° C. To the steel melt, added was Al in an amount of 0.4 kg/ton, by which the concentration of oxygen dissolved in the steel melt was lowered to 180 ppm. In this step, the Al concentration in the steel melt was 0.002% by weight. Then, the steel melt was deoxidized with Ti, by adding thereto an alloy of 70 wt. % Ti—Fe in an amount of 1.0 kg/ton. Next, FeNb and FeB were added to the steel melt to thereby condition the composition of the steel melt. After this, Fe-coated wire of 15 wt. % Ca-30 wt. % Si alloy-15 wt. % Met.Ca-40 wt. % Fe was added to the steel melt in an amount of 0.2 kg/ton, to treat the steel melt with Ca. After having been thus Ca-treated, the steel melt had a Ti content of 0.020% by weight, an Al content of 0.002% by weight and a Ca content of 0.0020% by weight.

Next, using a continuous, 2-strand slab casting device, the steel melt was continuously cast into slabs. In this step, the inclusions existing in the steel melt in the tundish were in the form of spherical grains having a mean composition of 50 wt. % $Ti_2O_3$-20 wt. % CaO-30 wt. % $Al_2O_3$. After continuous casting, the tundish and the immersion nozzle were checked, and a few deposits were found adhered to their inner walls.

Next, the continuous cast slab was hot-rolled into a sheet having a thickness of 3.5 mm, which was then cold-rolled to have a thickness of 0.8 mm, and thereafter continuously annealed. Non-metallic inclusion defects of scabs, slivers, scale and the like were found in the surface of the annealed sheet at a low frequency of 0.02/1000 m coil. Regarding the degree of rusting, the sheet presented no problem.

The cold-rolled sheet was electro-galvanized or hot-dip-galvanized, and the thus-galvanized sheets all had good surface properties.

The components constituting the steel sheet produced herein, and the mean composition of the major inclusions existing in the steel sheet and having a size of not smaller than 1 μm are shown in Table 1, as Sample No. 2 of the invention.

EXAMPLE 3

Production of Sample No. 3

300 tons of steel melt was, after having been taken out of a converter, decarbonized in an RH-type vacuum degassing device, whereby the steel melt was controlled to have a C content of 0.0016% by weight, an Si content of 0.008% by weight, an Mn content of 0.12% by weight, a P content of 0.012% by weight and an S content of 0.004% by weight, and the temperature of the steel melt was controlled to 1590° C. To the steel melt, added was Al in an amount of 0.45 kg/ton, by which the concentration of oxygen dissolved in the steel melt was lowered to 160 ppm. In this step, the Al concentration in the steel melt was 0.003% by weight. Then, the steel melt was deoxidized with Ti, by adding thereto an alloy of 70 wt. % Ti—Fe in an amount of 1.4 kg/ton. Next, FeNb was added to the steel melt to thereby condition the composition of the steel melt. After this, an alloy of 20 wt. % Ca-50 wt. % Si-15 wt. % REM was added to the steel melt in an amount of 0.2 kg/ton, in a vacuum chamber. After having been thus treated, the steel melt had a Ti content of 0.050% by weight, an Al content of 0.002% by weight, a Ca content of 0.0007% by weight, and a REM content of 0.0013% by weight.

Next, using a continuous, 2-strand slab casting device, the steel melt was continuously cast into slabs. In this step, the inclusions existing in the steel melt in the tundish were in the form of spherical grains having a mean composition of 65 wt. % $Ti_2O_3$-5 wt. % CaO-12 wt. % REM oxides-18 wt. % $Al_2O_3$. During the casting step, no Ar gas was blown into the tundish and the immersion nozzle. After the continuous casting, the tundish and the immersion nozzle were checked, and a few deposits were found to have adhered onto their inner walls.

Next, the continuous cast slab was hot-rolled into a sheet having a thickness of 3.5 mm, which was then cold-rolled to a thickness of 0.8 mm, and thereafter continuously annealed. Non-metallic inclusion defects of scabs, slivers, scale and the like were found in the surface of the annealed sheet at a low frequency of 0.00/1000 m coil. Regarding the degree of rusting, the sheet presented no problem. The cold-rolled sheet was electro-galvanized or hot-dip-galvanized, and the thus-galvanized sheets all had good surface properties.

The components constituting the steel sheet produced herein, and the mean composition of the major inclusions existing in the steel sheet and having a size of not smaller than 1 μm are shown in Table 1, as Sample No. 3 of the invention.

EXAMPLE 4

Production of Samples Nos. 4 to 20

300 tons of steel melt were, after having been taken out of a converter, decarbonized in an RH-type vacuum degassing device, whereby the steel melt was controlled to have a C content of from 0.0010 to 0.0050% by weight, an Si content of from 0.004 to 0.5% by weight, an Mn content of from 0.10 to 1.8% by weight, a P content of from 0.010 to 0.020% by weight and an S content of from 0.004 to 0.012% by weight, and the temperature of the steel melt was controlled to fall between 1585° C. and 1615° C. Al was added to the steel melt in an amount of from 0.2 to 0.8 kg/ton, by which the concentration of oxygen dissolved in the steel melt was lowered to fall between 55 and 260 ppm. In this step, the Al concentration in the steel melt was from 0.001 to 0.008% by weight. Then, the steel melt was deoxidized with Ti, by adding thereto an alloy of 70 wt. % Ti—Fe in an amount of from 0.8 to 1.8 kg/ton. Next, any of FeNb, FeB, Met.Mn, FeSi and the like was added to the steel melt to thereby condition the composition of the steel melt. After this, any of an alloy of 30 wt. % Ca-60 wt. % Si, an additive mixture comprising the alloy and any of Met.Ca, Fe and from 5 to 15% by weight of REM, a Ca alloy such as 90 wt. % Ca-5 wt. % Ni alloy or the like, and Fe-coated wire of a REM alloy was added to the steel melt in an amount of from 0.05 to 0.5 kg/ton, with which the steel melt was treated. After having been thus treated, the steel melt had a Ti content of from 0.018 to 0.090% by weight, an Al content of from 0.001 to 0.008% by weight, a Ca content of from 0.0004 to 0.0035% by weight, and a REM content of from 0.0000 to 0.00020% by weight.

Next, using a continuous, 2-strand slab casting device, the steel melt was continuously cast into slabs. In this step, the inclusions existing in the steel melt in the tundish were in the form of spherical grains having a mean composition of (25 to 85 wt. % $Ti_2O_3$)-(5 to 45 wt. % CaO)-(6 to 41 wt. % $Al_2O_3$)-(0 to 18 wt. % REM oxides). During the casting step, no Ar gas was blown into the tundish and the immersion nozzle. After the continuous casting, the tundish and the immersion nozzle were checked, and few deposits were found adhered onto their inner walls.

Next, each continuous cast slab was hot-rolled into a sheet having a thickness of 3.5 mm, which was then cold-rolled to have a thickness of 0.8 mm, and thereafter continuously annealed. Non-metallic inclusion defects of scabs, slivers, scale and the like were found in the surface of each annealed sheet at a low frequency of from 0.00 to 0.02/1000 meter coil.

Regarding the degree of rusting, each sheet presented no problem. Each cold-rolled sheet was electro-galvanized or hot-dip-galvanized, and the thus-galvanized sheets all had good surface properties.

The components constituting each steel sheet produced herein, and the mean composition of the major inclusions existing in each steel sheet and having a size of not smaller than 1 μm are shown in Table 1, as Samples Nos. 4 to 20 of the invention.

EXAMPLE 5

Production of Sample No. 21

300 tons of steel melt that had been decarbonized in a converter was taken out of the converter, and subjected to primary deoxidation with 0.3 kg/ton of Al, 3.0 kg/ton of FeSi and 4.0 kg/ton of FeMn all added thereto. In this step, the steel melt had an Al content of 0.003% by weight. Next, the steel melt was deoxidized with Ti in an RH-type vacuum degassing device, by adding thereto an alloy of 70 wt. %

Ti—Fe in an amount of 1.5 kg/ton. Then, the composition of the steel melt was conditioned to have a C content of 0.03% by weight, an Si content of 0.2% by weight, an Mn content of 0.30% by weight, a P content of 0.015% by weight, an S content of 0.010% by weight, a Ti content of 0.033% by weight, and an Al content of 0.003% by weight. After this, wire of 30 wt. % Ca-60 wt. % Si was added to the steel melt in an amount of 0.3 kg/ton. After having been thus Ca-treated, the steel melt had a Ca content of 20 ppm.

Next, using a continuous, 2-strand slab casting device, the steel melt was continuously cast into slabs. In this step, the inclusions existing in the steel melt in the tundish were in the form of spherical grains having a mean composition of 62 wt. % $Ti_2O_3$-12 wt. % CaO-22 wt. % $Al_2O_3$. During the casting step, no Ar gas was blown into the tundish and the immersion nozzle. After continuous casting, few deposits adhered onto the inner wall of the immersion nozzle.

Next, the continuous cast slab was hot-rolled into a sheet having a thickness of 3.5 mm, which was then cold-rolled to have a thickness of 0.8 mm. Non-metallic inclusion defects were found in the surface of the cold-rolled sheet at a low frequency of not more than 0.02/1000 meter coil. Regarding the degree of rusting, the sheet presented no problem.

The cold-rolled sheet was electro-galvanized or hot-dip-galvanized, and the thus-galvanized sheets all had good surface properties.

The components constituting the steel sheet produced herein, and the mean composition of the major inclusions existing in the steel sheet and having a size of not smaller than 1 $\mu$m are shown in Table 2 below, as Sample No. 21 of the invention.

EXAMPLE 6

Production of Samples Nos. 22 to 31

300 tons of steel melt that had been decarbonized in a converter were taken out of the converter, and subjected to primary deoxidation with from 0.0 to 0.5 kg/ton of Al, from 0.5 to 6.0 kg/ton of FeSi and from 2.0 to 8.0 kg/ton of FeMn all added thereto. In this step, the steel melt had an Al content of from 0.000 to 0.007% by weight. Next, the steel melt was deoxidized with Ti in an RH-type vacuum degassing device, by adding thereto an alloy of 70 wt. % Ti—Fe in an amount of from 0.4 to 1.8 kg/ton. Then, the composition of the steel melt was conditioned to have a C content of from 0.02 to 0.35% by weight, an Si content of from 0.01 to 0.45% by weight, an Mn content of from 0.2 to 1.80% by weight, a P content of from 0.010 to 0.075% by weight, an S content of from 0.003 to 0.010% by weight, a Ti content of from 0.015 to 0.100% by weight, and an Al content of from 0.001 to 0.006% by weight. After this, any of an alloy of 30 wt. % Ca-60 wt. % Si, an additive mixture comprising the alloy and any of Met.Ca, Fe and from 5 to 15% by weight of REM, a Ca alloy such as 90 wt. % Ca-5 wt. % Ni alloy or the like, and Fe-coated wire of a REM alloy was added to the steel melt in an amount of from 0.05 to 0.5 kg/ton, with which the steel melt was treated. After having been thus Ca-treated, the steel melt had a Ca content of from 0.0015 to 0.0035% by weight.

Next, using a continuous, 2-strand slab casting device, the steel melt was continuously cast into slabs. In this step, the inclusions existing in the steel melt in the tundish were in the form of spherical grains having a mean composition of (36 to 70 wt. % $Ti_2O_3$)-(15 to 38 wt. % CaO)-(4 to 28 wt. % $Al_2O_3$). During the casting step, no Ar gas was blown into

TABLE 2

| | Components of Steel Sheet (wt. %) | | | | | | | | | | | |
|---|---|---|---|---|---|---|---|---|---|---|---|---|
| No. | C | Si | Mn | P | S | Al | Ti | T.Ca | REM | Nb | B | T(O) |
| 21 | 0.0300 | 0.200 | 0.30 | 0.015 | 0.010 | 0.003 | 0.028 | 0.0020 | 0.0000 | 0.001 | 0.0001 | 0.0043 |
| 22 | 0.0200 | 0.100 | 1.00 | 0.070 | 0.004 | 0.003 | 0.060 | 0.0015 | 0.0000 | 0.001 | 0.0010 | 0.0025 |
| 23 | 0.0500 | 0.200 | 0.30 | 0.015 | 0.005 | 0.003 | 0.025 | 0.0020 | 0.0000 | 0.001 | 0.0001 | 0.0025 |
| 24 | 0.1500 | 0.050 | 1.00 | 0.015 | 0.005 | 0.003 | 0.026 | 0.0030 | 0.0000 | 0.001 | 0.0001 | 0.0028 |
| 25 | 0.3500 | 0.200 | 0.80 | 0.015 | 0.005 | 0.002 | 0.030 | 0.0021 | 0.0000 | 0.001 | 0.0001 | 0.0022 |
| 26 | 0.0400 | 0.012 | 0.50 | 0.040 | 0.003 | 0.002 | 0.018 | 0.0015 | 0.0000 | 0.035 | 0.0010 | 0.0025 |
| 27 | 0.0700 | 0.010 | 1.75 | 0.075 | 0.004 | 0.004 | 0.012 | 0.0020 | 0.0000 | 0.001 | 0.0001 | 0.0030 |
| 28 | 0.1500 | 0.040 | 1.80 | 0.030 | 0.005 | 0.006 | 0.100 | 0.0021 | 0.0000 | 0.002 | 0.0001 | 0.0035 |
| 29 | 0.0250 | 0.450 | 0.70 | 0.015 | 0.010 | 0.001 | 0.027 | 0.0014 | 0.0000 | 0.001 | 0.0001 | 0.0032 |
| 30 | 0.0200 | 0.005 | 0.50 | 0.010 | 0.005 | 0.003 | 0.025 | 0.0015 | 0.0000 | 0.001 | 0.0001 | 0.0039 |
| 31 | 0.1200 | 0.100 | 0.20 | 0.015 | 0.010 | 0.002 | 0.015 | 0.0025 | 0.0010 | 0.001 | 0.0001 | 0.0026 |
| 32 | 0.0020 | 0.02 | 0.12 | 0.015 | 0.008 | 0.010 | 0.045 | 0.0015 | 0.0000 | 0.005 | 0.0005 | 0.0040 |

| | Composition of Inclusions (wt. %) | | | | | | Adhesion of | Defects | Rusting Percentage | |
|---|---|---|---|---|---|---|---|---|---|---|
| No. | CaO | REM Oxides | Ti Oxides | $Al_2O_3$ | $SiO_2$ | MnO | Inclusions in Nozzle | in Coil (/1000 m) | in Coil (%) | Remarks |
| 21 | 12 | 0 | 60 | 21 | 3 | 1 | No | 0 | 0.1 | Samples of the Invention |
| 22 | 23 | 0 | 45 | 28 | 1 | 2 | No | 0.01 | 0.2 | |
| 23 | 35 | 0 | 34 | 28 | 0 | 0 | No | 0.02 | 0.3 | |
| 24 | 37 | 0 | 54 | 4 | 1 | 2 | No | 0.01 | 0.2 | |
| 25 | 20 | 0 | 44 | 31 | 2 | 1 | No | 0.01 | 0.1 | |
| 26 | 13 | 0 | 64 | 19 | 0 | 1 | No | 0 | 0.1 | |
| 27 | 18 | 0 | 69 | 8 | 0 | 4 | No | 0.01 | 0.1 | |
| 28 | 22 | 0 | 45 | 26 | 0 | 4 | No | 0 | 0.1 | |
| 29 | 15 | 0 | 46 | 8 | 24 | 4 | No | 0 | 0.1 | |
| 30 | 19 | 0 | 53 | 24 | 0 | 1 | No | 0 | 0.1 | |
| 31 | 29 | 0 | 54 | 16 | 0 | 0 | No | 0.01 | 0.2 | |
| 32 | 10 | 0 | 25 | 59 | 1 | 0 | No | 0.03 | 0.1 | |

the tundish and the immersion nozzle. After the continuous casting, few deposits adhered onto the inner wall of the immersion nozzle.

Next, each slab was hot-rolled into a sheet coil having a thickness of 3.5 mm, which was then cold-rolled to have a thickness of 0.8 mm. Non-metallic inclusion defects were found in the surface of each hot-rolled sheet and in that of each cold-rolled sheet in a low frequency of from 0.00 to 0.02/1000 m coil. Regarding the degree of rusting, the sheets had no problem, like conventional sheets of steel as deoxidized with Al.

Each cold-rolled sheet was electro-galvanized or hot-dip-galvanized, and the thus-galvanized sheets all had good surface properties.

The components constituting each steel sheet produced herein, and the mean composition of the major inclusions existing in each steel sheet and having a size of not smaller than 1 μm are shown in Table 2, as Samples Nos. 22 to 31 of the invention.

EXAMPLE 7

Production of Sample No. 32

300 tons of steel melt was, after having been taken out of a converter, decarbonized in an RH-type vacuum degassing device, whereby the steel melt was controlled to have a C content of 0.0015% by weight, an Si content of 0.005% by weight, an Mn content of 0.12% by weight, a P content of 0.015% by weight and an S content of 0.008% by weight, and the temperature of the steel melt was controlled to be 1600° C. To the steel melt, added was Al in an amount of 1.0 kg/ton, by which the concentration of oxygen dissolved in the steel melt was lowered to 30 ppm. In this step, the Al concentration in the steel melt was 0.008% by weight. Then, the steel melt was deoxidized with Ti, by adding thereto an alloy of 70 wt. % Ti—Fe in an amount of 1.5 kg/ton. Next, FeNb and FeB were added to the steel melt to thereby condition the composition of the steel melt. After this, Fe-coated wire of 30 wt. % Ca-60 wt. % Al alloy was added to the steel melt in an amount of 0.3 kg/ton, to treat the steel melt with Ca. After having been thus Ca-treated, the steel melt had a Ti content of 0.045% by weight, an Al content of 0.010% by weight and a Ca content of 0.0015% by weight.

Next, using a continuous, 2-strand slab casting device, the steel melt was continuously cast into slabs. In this step, the inclusions existing in the steel melt in the tundish were in the form of spherical grains having a mean composition of 30 wt. % $Ti_2O_3$-10 wt. % CaO-60 wt. % $Al_2O_3$. During the casting step, no Ar gas was blown into the tundish and the immersion nozzle. After continuous casting, the tundish and the immersion nozzle were checked, and only a few deposits adhered onto their inner walls.

Next, the continuous cast slab was hot-rolled into a sheet having a thickness of 3.5 mm, which was then cold-rolled to have a thickness of 1.2 mm, and thereafter continuously annealed. Non-metallic inclusion defects of scabs, slivers, scale and the like were found in the surface of the annealed sheet at a low frequency of not more than 0.03/1000 meter coil.

Regarding degree of rusting, the sheet presented no problem. The cold-rolled sheet was electro-galvanized or hot-dip-galvanized, and the thus-galvanized sheets all had good surface properties. The components constituting the steel sheet produced herein, and the mean composition of the major inclusions existing in the steel sheet and having a size of not smaller than 1 μm are shown in Table 2, as Sample No. 32 of the invention.

COMPARATIVE EXAMPLE 1

Production of Samples Nos. 33 and 34

300 tons of steel melt was, after having been taken out of a converter, decarbonized in an RH-type vacuum degassing device, whereby the steel melt was controlled to have a C content of 0.0014 or 0.025% by weight, an Si content of 0.006 or 0.025% by weight, an Mn content of 0.12 or 0.15% by weight, a P content of 0.013 or 0.020% by weight and an S content of 0.005 or 0.010% by weight, and the temperature of the steel melt was controlled to be 1590° C. To the steel melt, added was Al in an amount of from 1.2 to 1.6 kg/ton, with which the steel melt was deoxidized. After having been thus deoxidized, the steel melt had an Al content of 0.008 or 0.045% by weight. Next, FeTi was added to the steel melt in an amount of from 0.5 to 0.6 kg/ton, and FeNb and FeB were added thereto to thereby condition the composition of the steel melt. The thus-processed steel melt had a Ti content of 0.035 or 0.040% by weight.

Next, using a continuous, 2-strand slab casting device, the steel melt was continuously cast into slabs. In this step, major inclusions existed in the steel melt in the tundish, in clusters having a mean composition comprising 72 or 98% by weight of $Al_2O_3$ and 2 or 25% by weight of $Ti_2O_3$.

Where no Ar gas was blown into the tundish and the immersion nozzle during casting, much $Al_2O_3$ adhered onto the inner wall of the nozzle. In the third charging, the degree of sliding nozzle opening increased too much, and casting was stopped due to nozzle clogging. On the other hand, even when Ar gas was blown in, much $Al_2O_3$ also adhered onto the inner wall of the nozzle. In the eighth charging, the melt level in the mold fluctuated too much, and the casting was stopped.

Next, each continuous cast slab produced herein was hot-rolled into a sheet having a thickness of 3.5 mm, which was then cold-rolled to have a thickness of 1.2 mm, and thereafter continuously annealed at 780° C. Non-metallic inclusion defects of scabs, slivers, scale and the like were found in the surface of each annealed sheet at a frequency of 0.45 or 0.55/1000 m coil.

The components constituting each steel sheet produced herein, and the mean composition of the major inclusions existing in each steel sheet and having a size of not smaller than 1 μm are shown in Table 3, as Comparative Samples Nos. 33 and 34 in Table 3 which follows.

TABLE 3

| | Components of Steel Sheet (wt. %) | | | | | | | | | | | |
|---|---|---|---|---|---|---|---|---|---|---|---|---|
| No. | C | Si | Mn | P | S | Al | Ti | T.Ca | REM | Nb | B | T(O) |
| 33 | 0.0015 | 0.006 | 0.15 | 0.020 | 0.005 | 0.035 | 0.040 | 0.0000 | 0.0000 | 0.003 | 0.0005 | 0.0015 |
| 34 | 0.0025 | 0.025 | 0.12 | 0.013 | 0.010 | 0.010 | 0.035 | 0.0000 | 0.0000 | 0.006 | 0.0002 | 0.0016 |

TABLE 3-continued

| | | | | | | | | | | | | |
|---|---|---|---|---|---|---|---|---|---|---|---|---|
| 35 | 0.0013 | 0.006 | 0.15 | 0.015 | 0.012 | 0.002 | 0.025 | 0.0000 | 0.0000 | 0.001 | 0.0005 | 0.0026 |
| 36 | 0.0018 | 0.032 | 0.10 | 0.015 | 0.005 | 0.025 | 0.030 | 0.0025 | 0.0000 | 0.003 | 0.0005 | 0.0020 |
| 37 | 0.0015 | 0.005 | 0.12 | 0.012 | 0.005 | 0,030 | 0.040 | 0.0004 | 0.0000 | 0.003 | 0.0030 | 0.0013 |
| 38 | 0.0017 | 0.018 | 0.15 | 0.015 | 0.005 | 0.033 | 0.032 | 0.0010 | 0.0000 | 0.003 | 0.0008 | 0.0016 |
| 39 | 0.0015 | 0.006 | 0.13 | 0.013 | 0.005 | 0.003 | 0.015 | 0.0004 | 0.0000 | 0.001 | 0.0002 | 0.0059 |
| 40 | 0.0016 | 0.018 | 0.14 | 0.014 | 0.004 | 0.005 | 0.025 | 0.0050 | 0.0000 | 0.003 | 0.0003 | 0.0045 |
| 41 | 0.0020 | 0.018 | 0.15 | 0.010 | 0.005 | 0.003 | 0.030 | 0.0060 | 0.0020 | 0.003 | 0.0005 | 0.0039 |
| 42 | 0.0200 | 0.035 | 0.35 | 0.012 | 0.007 | 0.032 | 0.008 | 0.0000 | 0.0000 | 0.003 | 0.0001 | 0.0016 |
| 43 | 0.0350 | 0.018 | 0.40 | 0.012 | 0.005 | 0.002 | 0.045 | 0.0000 | 0.0000 | 0.000 | 0.0004 | 0.0012 |
| 44 | 0.0400 | 0.018 | 0.50 | 0.015 | 0.006 | 0.003 | 0.040 | 0.0004 | 0.0000 | 0.000 | 0.0000 | 0.0038 |

| | Composition of Inclusions (wt. %) Comparative Examples | | | | | | Adhesion of | Defects | Rusting Percentage | |
|---|---|---|---|---|---|---|---|---|---|---|
| No. | CaO | REM Oxides | Ti Oxides | $Al_2O_3$ | $SiO_2$ | MnO | Inclusions in Nozzle | in Coil (/1000 m) | in Coil (%) | Remarks |
| 33 | 0 | 0 | 2 | 97 | 0 | 0 | Yes | 0.45 | 0.1 | Comparative |
| 34 | 0 | 0 | 25 | 70 | 2 | 1 | Yes | 0.55 | 0.1 | Samples |
| 35 | 0 | 0 | 92 | 7 | 0 | 0 | Great | 0.03 | 0.1 | |
| 36 | 44 | 0 | 2 | 53 | 0 | 0 | No | 0.05 | 5.5 | |
| 37 | 12 | 0 | 1 | 85 | 0 | 0 | Great | 1.24 | 0.2 | |
| 38 | 21 | 0 | 1 | 76 | 0 | 0 | Great | 0.25 | 0.3 | |
| 39 | 4 | 0 | 91 | 3 | 1 | 0 | Great | 0.08 | 0.1 | |
| 40 | 56 | 0 | 24 | 19 | 0 | 0 | No | 0.08 | 2.3 | |
| 41 | 47 | 11 | 25 | 15 | 0 | 0 | No | 0.15 | 3.2 | |
| 42 | 0 | 0 | 2 | 97 | 0 | 0 | Yes | 0.27 | 0.1 | |
| 43 | 0 | 0 | 87 | 12 | 0 | 0 | Great | 0.02 | 0.1 | |
| 44 | 4 | 0 | 84 | 11 | 0 | 0 | Great | 0.08 | 0.2 | |

COMPARATIVE EXAMPLE 2

Production of Sample No. 35

300 tons of steel melt was, after having been taken out of a converter, decarbonized in an RH-type vacuum degassing device, whereby the steel melt was controlled to have a C content of 0.0012% by weight, an Si content of 0.006% by weight, an Mn content of 0.15% by weight, a P content of 0.015% by weight and an S content of 0.012% by weight, and the temperature of the steel melt was controlled to be 1595° C. To the steel melt, added was Al in an amount of 0.4 kg/ton, by which the concentration of oxygen dissolved in the steel melt was lowered to 120 ppm. After having been thus processed, the steel melt had an Al content of 0.002% by weight. The steel melt was then deoxidized with Ti by adding thereto an alloy of 70 wt. % Ti—Fe in an amount of 1.0 kg/ton. Next, FeNb and FeB were added thereto to thereby condition the composition of the steel melt. The thus-processed steel melt had a Ti content of 0.025% by weight.

Next, using a continuous, 2-strand slab casting device, the steel melt was continuously cast into slabs. In this step, major inclusions existing in the steel melt in the tundish were in the form of granules having a mean composition of 92 wt. % $Ti_2O_3$-8 wt. % $Al_2O_3$.

Where no Ar gas was blown into the tundish and the immersion nozzle during casting, much steel and much (85 to 95 wt. % $Ti_2O_3$)-$Al_2O_3$ adhered onto the inner wall of the nozzle. In the second charging, the degree of sliding nozzle opening increased too much, and the casting was stopped due to nozzle clogging. On the other hand, even when Ar gas was blown in, much (85 to 95 wt. % $Ti_2O_3$)-$Al_2O_3$ also adhered onto the inner wall of the nozzle. In the third charging, the melt level in the mold fluctuated too much, and the casting was stopped.

Next, the continuous cast slab produced herein was hot-rolled into a sheet having a thickness of 3.5 mm, which was then cold-rolled to a thickness of 0.8 mm, and thereafter continuously annealed. Non-metallic inclusion defects of scabs, slivers, scale and the like were found in the surface of the annealed sheet at a low frequency of 0.03/1000 meter coil.

The components constituting the steel sheet produced herein, and the mean composition of the major inclusions existing in the steel sheet and having a size of not smaller than 1 $\mu$m are shown in Table 3, as Comparative Sample No. 35.

COMPARATIVE EXAMPLE 3

Production of Sample No. 36

300 tons of steel melt was, after having been taken out of a converter, decarbonized in an RH-type vacuum degassing device, whereby the steel melt was controlled to have a C content of 0.0012% by weight, an Si content of 0.006% by weight, an Mn content of 0.10% by weight, a P content of 0.015% by weight and an S content of 0.012% by weight, and the temperature of the steel melt was controlled to be 1600° C. To the steel melt, added was Al in an amount of 1.6 kg/ton, with which the steel melt was deoxidized. After having been thus deoxidized, the steel melt had an Al content of 0.030% by weight. Next, FeTi was added to the steel melt in an amount of 0.45 kg/ton, and FeNb and FeB were added thereto to thereby condition the composition of the steel melt. The thus-processed steel melt had a Ti content of 0.032% by weight. Next, Fe-coated wire of an alloy of 30 wt. % Ca-60 wt. % Si was added to the steel melt in an amount of 0.45 kg/ton, with which the steel melt was Ca-treated. After having been thus Ca-treated, the steel melt had a Ti content of 0.032% by weight, an Al content of 0.030% by weight, and a Ca content of 0.0030% by weight.

Next, using a continuous, 2-strand slab casting device, the steel melt was continuously cast into slabs. In this step, the major inclusions existing in the steel melt in the tundish were in the form of spherical grains having a mean oxide composition of 53 wt. % $Al_2O_3$-45 wt. % CaO-2 wt. % $Ti_2O_3$. The inclusions contained 15% by weight of S.

During the casting step, no Ar gas was blown into the tundish and the immersion nozzle. After the continuous casting, the tundish and the immersion nozzle were checked, and found were few deposits adhered onto their inner walls.

Next, the continuous cast slab was hot-rolled into a sheet having a thickness of 3.5 mm, which was then cold-rolled to have a thickness of 0.8 mm, and thereafter continuously annealed. Non-metallic inclusion defects of scabs, slivers, scale and the like were found in the surface of the annealed sheet at a low frequency of not more than 0.03/1000 m coil. However, the rusting resistance of the sheet was much inferior. In a rusting test where sheet samples were kept for 500 hours in a thermo-hygrostat at a temperature of 60° C. and at a humidity of 95%, the rusting percentage of the sheet produced herein was larger by 50 times or more than that of conventional sheet deoxidized with Al.

The components constituting the steel sheet produced herein, and the mean composition of the major inclusions existing in the steel sheet and having a size of not smaller than 1 $\mu$m are shown in Table 3, as Comparative Sample No. 36.

COMPARATIVE EXAMPLE 4

Production of Samples Nos. 37 and 38

300 tons of steel melt was, after having been taken out of a converter, decarbonized in an RH-type vacuum degassing device, whereby the steel melt was controlled to have a C content of 0.0015 or 0.017% by weight, an Si content of 0.004 or 0.008% by weight, an Mn content of 0.12 or 0.15% by weight, a P content of 0.012 or 0.015% by weight and an S content of 0.005% by weight, and the temperature of the steel melt was controlled to be 1600° C. To the steel melt, added was Al in an amount of 1.6 kg/ton, with which the steel melt was deoxidized. After having been thus deoxidized, the steel melt had an Al content of 0.035% by weight. Next, FeTi was added to the steel melt in an amount of from 0.45 to 0.50 kg/ton, and FeNb and FeB were added thereto to thereby condition the composition of the steel melt. The thus-processed steel melt had a Ti content of from 0.035 to 0.045% by weight. Next, Fe-coated wire of an alloy of 30 wt. % Ca-60 wt. % Si was added to the steel melt in an amount of from 0.08 to 0.20 kg/ton, with which the steel melt was Ca-treated. After having been thus Ca-treated, the steel melt had a Ti content of 0.035 or 0.042% by weight, an Al content of 0.035 or 0.038% by weight, and a Ca content of 0.0004 or 0.0010% by weight.

Next, using a continuous, 2-strand slab casting device, the steel melt was continuously cast into slabs. In this step, the major inclusions existing in the steel melt in the tundish were in the form of granules but partly in clusters, having a mean composition of (77 or 87 wt. % $Al_2O_3$)-(12 or 22 wt. % CaO)-1 wt. % $Ti_2O_3$.

During the casting step, Ar gas was blown into the tundish and into the immersion nozzle. In the second charging, however, the degree of sliding nozzle opening increased too much, and the casting was stopped due to nozzle clogging. After continuous casting, the tundish and the immersion nozzle were checked, and we found much (0 to 25 wt. % CaO)-(75 to 100 wt. % $Al_2O_3$) adhered onto their inner walls.

Next, each continuous cast slab produced herein was hot-rolled into a sheet having a thickness of 3.5 mm, which was then cold-rolled to have a thickness of 0.8 mm, and thereafter continuously annealed. Many non-metallic inclusion defects of scabs, slivers, scale and the like were found in the surface of each annealed sheet at a high frequency of from 0.25 to 1.24/1000 m coil. In addition, the rusting resistance of the sheets produced herein was much inferior to that of conventional sheets of steel as deoxidized with Al. In a rusting test where sheet samples were kept in a thermo-hygrostat at a temperature of 60° C. and at a humidity of 95%, the rusting percentage of the sheets produced herein was 2 or 3 times that of the conventional sheet having been deoxidized with Al, after 500 hours.

The components constituting each steel sheet produced herein, and the mean composition of the major inclusions existing in each steel sheet and having a size of not smaller than 1 $\mu$m are shown in Table 3, as Comparative Samples Nos. 37 and 38.

COMPARATIVE EXAMPLE 5

Production of Sample No. 39

300 tons of steel melt was, after having been taken out of a converter, decarbonized in an RH-type vacuum degassing device, whereby the steel melt was controlled to have a C content of 0.0012% by weight, an Si content of 0.004% by weight, an Mn content of 0.12% by weight, a P content of 0.013% by weight and an S content of 0.005% by weight, and the temperature of the steel melt was controlled to 1590° C. To the steel melt, added was Al in an amount of 0.2 kg/ton, by which the concentration of oxygen dissolved in the steel melt was lowered to 210 ppm. After having been thus deoxidized, the steel melt had an Al content of 0.003% by weight. FeTi was added to the steel melt in an amount of 0.80 kg/ton, and FeNb and FeB were added thereto to thereby condition the composition of the steel melt. The thus-processed steel melt had a Ti content of 0.020% by weight. After this, Fe-coated wire of an alloy of 30 wt. % Ca-60 wt. % Si was added to the steel melt in an amount of from 0.08 kg/ton, with which the steel melt was Ca-treated. After having been thus Ca-treated, the steel melt had a Ti content of 0.018% by weight, an Al content of 0.003% by weight, and a Ca content of 0.0004% by weight.

Next, using a continuous, 2-strand slab casting device, the steel melt was continuously cast into slabs. In this step, the major inclusions existing in the steel melt in the tundish were in the form of granules having a mean oxide composition of 3 wt. % $Al_2O_3$-4 wt. % CaO-92 wt. % $Ti_2O_3$-1 wt. % $SiO_2$.

Where no Ar gas was blown into the tundish and the immersion nozzle during casting, much steel and much (85 to 95 wt. % $Ti_2O_3$)-(0 to 5 wt. % CaO)-(2 to 10 wt. % $Al_2O_3$) adhered onto the inner wall of the nozzle. In the second charging, the degree of sliding nozzle opening increased too much, and the casting was stopped due to nozzle clogging. On the other hand, even when Ar gas was blown into them, much (85 to 95 wt. % $Ti_2O_3$)-(0 to 5 wt. % CaO)-(2 to 10 wt. % $Al_2O_3$) also adhered onto the inner wall of the nozzle. In the third charging, the melt level in the mold fluctuated too much, and the casting was stopped.

Next, the continuous cast slab produced herein was hot-rolled into a sheet having a thickness of 3.5 mm, which was then cold-rolled to have a thickness of 0.8 mm, and thereafter continuously annealed. Non-metallic inclusion defects of scabs, slivers, scale and the like were found in the surface of the annealed sheet at a frequency of 0.08/1000 m coil.

The components constituting the steel sheet produced herein, and the mean composition of the major inclusions existing in the steel sheet and having a size of not smaller than 1 $\mu$m are shown in Table 3, as Comparative Sample No. 39.

COMPARATIVE EXAMPLE 6

Production of Samples Nos. 40 and 41

300 tons of steel melt was, after having been taken out of a converter, decarbonized in an RH-type vacuum degassing device, whereby the steel melt was controlled to have a C content of 0.0012 or 0.015% by weight, an Si content of 0.005% by weight, an Mn content of 0.14 or 0.15% by weight, a P content of 0.010 or 0.014% by weight and an S content of 0.004 or 0.005% by weight, and the temperature of the steel melt was controlled to 1600° C. To the steel melt, added was Al in an amount of 0.5 kg/ton, with which the steel melt was deoxidized, whereby the concentration of oxygen dissolved in the steel melt was lowered to a value between 80 and 120 ppm. After having been thus deoxidized, the steel melt had an Al content of from 0.003 to 0.005% by weight. Next, FeTi was added to the steel melt in an amount of from 0.65 to 0.80 kg/ton, and FeNb and. FeB were added thereto to thereby condition the composition of the steel melt. The thus-processed steel melt had a Ti content of from 0.030 to 0.035% by weight. Next, Fe-coated wire of an alloy of 30 wt. % Ca-60 wt. % Si was added to the steel melt in an amount of 1.00 kg/ton, or an additive that had been prepared by adding 10% by weight of REM to the alloy of 20 wt. % Ca-60 wt. % Si was added thereto in an amount of 0.8 kg/tom. After having been thus processed, the steel melt had a Ti content of 0.025 or 0.030% by weight, an Al content of 0.003 or 0.005% by weight, a Ca content of 0.0052 or 0.0062% by weight, and a REM content of 0.0000 or 0.0020% by weight.

Next, using a continuous, 2-strand slab casting device, the steel melt was continuously cast into slabs. In this step, the inclusions existing in the steel melt in the tundish were in the form of spherical grains having a composition of (25 wt. % $Ti_2O_3$)-(48 or 56 wt. % CaO)-(15 or 19 wt. % $Al_2O_3$)-(0 or 12 wt. % REM oxides). The inclusions contained 14% by weight of S.

During the casting step, no Ar gas was blown into the tundish and the immersion nozzle. After continuous casting, the tundish and the immersion nozzle were checked, and found were few deposits were adhered onto their inner walls.

Next, each continuous cast slab produced herein was hot-rolled into a sheet having a thickness of 3.5 mm, which was then cold-rolled to a thickness of 0.8 mm, and thereafter continuously annealed. Many non-metallic inclusion defects of scabs, slivers, scale and the like were found in the surface of each annealed sheet at a high frequency of from 0.08 to 0.15/1000 meter coil. In addition, the rusting resistance of the sheets produced herein was much inferior to that of conventional sheets of steel as deoxidized with Al. In a rusting test where sheet samples were kept in a thermo-hygrostat at a temperature of 60° C. and at a humidity of 95%, the rusting percentage of the sheets produced herein was 20 to 30 times or more than that of the conventional sheet deoxidized with Al, in 500 hours.

The components constituting each steel sheet produced herein, and the mean composition of the major inclusions existing in each steel sheet and having a size of not smaller than 1 $\mu$m are shown in Table 3, as Comparative Samples Nos. 40 and 41.

COMPARATIVE EXAMPLE 7

Production of Sample No. 42

300 tons of steel melt that had been decarbonized in a converter were taken out of the converter, to which were added 1.2 kg/ton of Al, 0.5 kg/ton of FeSi and 5.0 kg/ton of FeMn. Next, this was deoxidized in an RH-type vacuum degassing device, and 0.15 kg/ton of an alloy of 70 wt. % Ti—Fe was added thereto, and FeNb and FeB were added thereto, by which the composition of the steel melt was conditioned. The thus-processed steel melt had a C content of 0.02% by weight, an Si content of 0.03% by weight, an Mn content of 0.35% by weight, a P content of 0.012% by weight, an S content of 0.007% by weight, a Ti content of 0.008% by weight, and an Al content of 0.035% by weight.

Next, using a continuous, 2-strand slab casting device, the steel melt was continuously cast into slabs. In this step, the inclusions existing in the steel melt in the tundish were in clusters having a mean composition comprising 98% by weight of $Al_2O_3$ and up to 2% by weight of $Ti_2O_3$.

Where no Ar gas was blown into the tundish and the immersion nozzle during casting, much $Al_2O_3$ adhered onto the inner wall of the nozzle. In the third charging, the degree of sliding nozzle opening increased too much, and the casting was stopped due to nozzle clogging. On the other hand, even when Ar gas was blown in, much $Al_2O_3$ also adhered to the inner wall of the nozzle. In the ninth charging, the melt level in the mold fluctuated too much, and the casting was stopped.

Next, the continuous cast slab was hot-rolled into a sheet having a thickness of 3.5 mm, which was then cold-rolled to a thickness of 0.8 mm, and thereafter continuously annealed. Non-metallic inclusion defects were found in the surface of the annealed sheet at a frequency of 0.27/1000 meter coil.

The components constituting the steel sheet produced herein, and the mean composition of the major inclusions existing in the steel sheet and having a size not smaller than 1 $\mu$m are shown in Table 3, as Comparative Sample No. 42.

COMPARATIVE EXAMPLE 8

Production of Sample No. 43

300 tons of steel melt that had been decarbonized in a converter were taken out of the converter, and deoxidized with 0.3 kg/ton of Al, 0.2 kg/ton of FeSi and 5.0 kg/ton of FeMn all added thereto. In this step, the steel melt had an Al content of 0.003% by weight. Next, the steel melt was deoxidized with Ti in an RH-type vacuum degassing device, by adding thereto an alloy of 70 wt. % Ti—Fe in an amount of 0.9 kg/ton. The thus-processed steel melt had a C content of 0.035% by weight, an Si content of 0.018% by weight, an Mn content of 0.4% by weight, a P content of 0.012% by weight, an S content of 0.005% by weight, a Ti content of 0.047% by weight, and an Al content of 0.002% by weight. Next, using a continuous, 2-strand slab casting device, the steel melt was continuously cast into slabs. In this step, the major inclusions existing in the steel melt in the tundish were in the form of spherical grains having a mean composition of 88 wt. % $Ti_2O_3$-12 wt. % $Al_2O_3$.

Where no Ar gas was blown into the tundish and the immersion nozzle during casting, much steel and (85 to 95 wt. % $Ti_2O_3$)-(5 to 15 wt. % $Al_2O_3$) adhered onto the inner wall of the nozzle. In the second charging, the degree of sliding nozzle opening increased too much, and the casting was stopped due to nozzle clogging. On the other hand, even when Ar gas was blown in, much (85 to 95 wt. % $Ti_2O_3$)-(5 to 15 wt. % $Al_2O_3$) also adhered to the inner wall of the nozzle. In the third charging, the melt level in the mold fluctuated too much, and the casting was stopped.

Next, the continuous cast slab was hot-rolled into a sheet having a thickness of 3.5 mm, which was then cold-rolled to have a thickness of 0.8 mm, and thereafter continuously annealed. Non-metallic inclusion defects of scabs, slivers, scale and the like were found in the surface of the annealed sheet at a low frequency of not more than 0.02/1000 meter coil.

The components constituting the steel sheet produced herein, and the mean composition of the major inclusions existing in the steel sheet and having a size of not smaller than 1 $\mu$m are shown in Table 3, as Comparative Sample No. 43.

COMPARATIVE EXAMPLE 9

Production of Sample No. 44

300 tons of steel melt that had been decarbonized in a converter were taken out of the converter, and deoxidized with 0.3 kg/ton of Al and 6.0 kg/ton of FeMn both added thereto. In this step, the steel melt had an Al content of from 0.003% by weight. Next, the steel melt was further deoxidized with Ti in an RH-type vacuum degassing device, by adding thereto an alloy of 70 wt. % Ti—Fe in an amount of 0.8 kg/ton. Then, FeNb and FeB were added to the steel melt to condition the composition of the steel melt. Next, the steel melt was Ca-treated with 0.08 kg/ton of Fe-coated wire of an alloy of 30 wt. % Ca-60 wt. % Si added thereto. After having been thus processed, the steel melt had a Ti content of 0.040% by weight, an Al content of 0.003% by weight and a Ca content of 0.0004% by weight.

Next, using a continuous, 2-strand slab casting device, the steel melt was continuously cast into slabs. In this step, the major inclusions existing in the steel melt in the tundish were in the form of granules having a mean oxide composition of 11 wt. % $Al_2O_3$-4 wt. % CaO-85 wt. % $Ti_2O_3$.

Where no Ar gas was blown into the tundish and the immersion nozzle during casting, much steel and (85 to 95 wt. % $Ti_2O_3$)-(0 to 5 wt. % CaO)-(2 to 10 wt. % $Al_2O_3$) adhered onto the inner wall of the nozzle. In the second charging, the degree of sliding nozzle opening increased too much, and the casting was stopped due to nozzle clogging. On the other hand, even when Ar gas was blown in, much (85 to 95 wt. % $Ti_2O_3$)-(0 to 5 wt. % CaO)-(2 to 10 wt. % $Al_2O_3$) also adhered onto the inner wall of the nozzle. In the third charging, the melt level in the mold fluctuated too much, and the casting was stopped.

Next, the continuous cast slab was hot-rolled into a sheet having a thickness of 3.5 mm, which was then cold-rolled to have a thickness of 0.8 mm, and thereafter continuously annealed. Non-metallic inclusion defects of scabs, slivers, scale and the like were found in the surface of the annealed sheet in a frequency of 0.08/1000 meter coil.

The components constituting the steel sheet produced herein, and the mean composition of the major inclusions existing in the steel sheet and having a size of not smaller than 1 $\mu$m are shown in Table 3, as Comparative Sample No. 44.

As described in detail hereinabove, the titanium killed steel sheets of the present invention do not cause immersion nozzle clogging while they are produced in a continuous casting process. After having been rolled, the sheets had few surface defects that might be caused by non-metallic inclusions existing therein, and their surfaces were extremely clear. In addition, the sheets rusted very little. Therefore, the steel sheets of the invention are extremely advantageous for producing car bodies.

While the invention has been described in detail and with reference to specific embodiments thereof, it will be apparent to one skilled in the art that various changes and modifications can be made therein without departing from the spirit and scope of the invention as defined in the appended claims.

What is claimed is:

1. A titanium killed steel sheet deoxidized with Ti and having oxide inclusions, said sheet containing critical ingredients including Ti, in such proportions that:

(a) when the Ti content of said steel is between about 0.010 and about 0.50% by weight, the weight ratio of Ti content to Al content of the steel is equal to or greater than about 5, (b) when the Ti content of said steel is equal to or greater than about 0.010% by weight and the Al content thereof is equal to or smaller than about 0.015% by weight, the weight ratio of Ti content to Al content is less than about 5;

(c) said steel further comprising an element selected from the group consisting of Ca and metals REM, present in an amount of about 0.0005% by weight or more, wherein (d) said oxide inclusions in said steel are such that the amount of any one or two of said CaO and REM oxides is between about 5 and 50% by weight of the total amount of the oxide inclusions, the amount of Ti oxides is not larger than about 90% by weight of the total amount of said oxide inclusions, and wherein (e) the amount of $Al_2O_3$ is not larger than about 70% by weight of the total amount of said oxide inclusions.

2. The titanium killed steel sheet as claimed in claim 1, wherein said steel satisfies the following requirements:

when the Ti content of said steel is between about 0.025 and 0.50% by weight, the ratio of Ti content to Al content of said steel is equal to or greater than about 5;

when the Ti content of said steel is equal to or greater than about 0.025% by weight and the Al content thereof is equal to or less than about 0.015% by weight, the ratio of Ti content to Al content is less than about 5, and wherein the amount of Ti oxides in said steel is between about 20 and 90% by weight of the total amount of the oxide inclusions therein.

3. The titanium killed steel sheet as claimed in claim 1, wherein said steel contains Ti in an amount of from about 0.025 to 0.075% by weight while satisfying said ratio of the Ti content to the Al content of the steel, and wherein the amount of Ti oxide in said steel is between about 20 and 90% by weight of the total amount of the oxide inclusions therein.

4. The titanium killed steel as claimed in claim 1, wherein said oxide inclusions in said steel further contain $SiO_2$ in an amount equal to or less than about 30% by weight of the total amount of oxide inclusions, and wherein MnO in an amount equal to or less than about 15% by weight of the total amount of the oxide inclusions.

5. The titanium killed steel as claimed in claim 1, wherein said steel contains C in an amount equal to or less than about 0.5% by weight, Si in an amount equal to or less than about 0.5% by weight, Mn in an amount of from about 0.05 to 2.0% by weight, and S in an amount equal to or less than about 0.050% by weight.

6. The titanium killed steel as claimed in claim 1, wherein at least about 80% by weight of the oxide inclusions in said steel are in the form of granulated or crushed particles having a mean particle size of not larger than about 50 $\mu$m.

7. A method for producing titanium killed steel sheet with good surface properties through deoxidation of steel melt with Ti, which is characterized in that said steel satisfies the following requirements:

when the Ti content of said steel is between about 0.010 and 0.50% by weight, the ratio of Ti content to Al content of said steel is equal to or greater than about 5;

when the Ti content of said steel is equal to or greater than about 0.010% by weight and the Al content thereof is equal to or less than about 0.015% by weight, the ratio of Ti content to Al content is less than about 5;

wherein said steel contains an element selected from the group consisting of Ca and metals REM in an amount of equal to or greater than about 0.0005% by weight;

and wherein the oxide inclusions in said steel are such that the amount of any one or two of said CaO and REM oxides is between about 5 and 50% by weight of the total amount of the oxide inclusions, and wherein the amount of Ti oxides is equal to or smaller than about 90% by weight of the total amount of the oxide inclusions, and wherein the amount of said $Al_2O_3$ is equal to or smaller than about 70% by weight of the total amount of the oxide inclusions.

8. The method for producing titanium killed steel sheets as claimed in claim 7, wherein the steel further satisfies the following requirements:

when the Ti content of the steel falls between about 0.025 and 0.50% by weight, the ratio of Ti content to Al content of the steel is equal to or greater than about 5;

when the Ti content of the steel is equal to or greater than about 0.025% by weight and the Al content thereof is equal to or smaller than about 0.015% by weight, the ratio of the Ti content to the Al content is equal to or smaller than about 5; and wherein the amount of Ti oxides in the steel is between about 20 and 90% by weight of the total amount of the oxide inclusions therein.

9. The method for producing titanium killed steel sheets as claimed in claim 7, wherein said steel contains Ti in an amount of from about 0.025 to 0.075% by weight while the ratio of Ti content to Al content of the steel is equal to or greater than about 5, and the amount of Ti oxides in the steel is between about 20 and 90% by weight of the total amount of the oxide inclusions therein.

10. The method for producing titanium killed steel sheets as claimed in claim 7, wherein the oxide inclusions in said steel further contain $SiO_2$ in an amount of not larger than about 30% by weight of the total amount of the oxide inclusions, and MnO in an amount not larger than about 15% by weight of the total amount of the oxide inclusions.

11. The method for producing titanium killed steel sheets as claimed in claim 7, wherein said steel contains C in an amount equal to or less than about 0.5% by weight, Si in an amount equal to or less than about 0.5% by weight, Mn of from about 0.05 to 2.0% by weight, and S in an amount equal to or less than about 0.050% by weight.

12. The method for producing titanium killed steel sheets as claimed in claim 7, wherein Ca is added to said steel in the form of powdery or granulated metal Ca, or in the form of granulated or massive Ca-containing alloys, or in the form of wires of said Ca-containing alloys.

13. The method for producing titanium killed steel sheets as claimed in claim 7, wherein the metals REM are added to the steel in the form of powdery or granulated metals REM, or in the form of granulated or massive REM-containing alloys, or in the form of wires of said REM-containing alloys.

14. The method for producing titanium killed steel sheets as claimed in claim 7, wherein said steel is continuously cast into a mold via a tundish and immersion nozzle without blowing argon gas or nitrogen gas into said tundish or into said immersion nozzle.

15. The method for producing titanium killed steel sheets as claimed in claim 7, wherein said steel is decarbonized by a vacuum degassing device and said steel is then deoxidized with a Ti-containing alloy, and wherein thereafter one or two of the elements selected from the group consisting of Ca and REM as well as an alloy or mixture containing one or more elements selected from the group consisting of Fe, Al, Si and Ti are added to the resulting steel melt.

16. The method for producing titanium killed steel sheets as claimed in claim 7, wherein said steel melt is decarbonized in a vacuum degassing device and then subjected to primary deoxidation with any of Al, Si and Mn to thereby reduce the amount of oxygen dissolved in said steel melt to about 200 ppm or less, and wherein the resulting steel melt is thereafter deoxidized with a Ti-containing alloy.

17. The method for producing titanium killed steel sheets as claimed in claim 12, wherein said Ca-containing alloys are selected from the group consisting of CaSi alloys, CaAl alloys and CaNi alloys.

18. The method for producing titanium killed steel sheets as claimed in claim 13, wherein said REM-containing alloys are Fe-REM alloys.

* * * * *

UNITED STATES PATENT AND TRADEMARK OFFICE

CERTIFICATE OF CORRECTION

PATENT NO.: 6,117,389
DATED: September 12, 2000
INVENTOR(S): Nabeshima et al

It is certified that error appears in the above-identified patent and that said Letters Patent is hereby corrected as shown below:

In column 12, at Table 1, at the subheading "Rusting Percentage in Coil (%)" at No. 1, please change "0.10" to --0.1--.

Signed and Sealed this

First Day of May, 2001

*Attest:*

Nicholas P. Godici

NICHOLAS P. GODICI

*Attesting Officer*

*Acting Director of the United States Patent and Trademark Office*